US011697515B2

(12) United States Patent
Xu

(10) Patent No.: US 11,697,515 B2
(45) Date of Patent: Jul. 11, 2023

(54) SLIDE BLOCK-BASED POSITIONING MECHANISM AND AUTOMATIC TIE TOOL HAVING THE SAME

(71) Applicant: SHENZHEN SWIFT AUTOMATION TECHNOLOGY CO., LTD., Shenzhen (CN)

(72) Inventor: Xiuyi Xu, Shenzhen (CN)

(73) Assignee: SHENZHEN SWIFT AUTOMATION TECHNOLOGY CO., LTD., Shenzhen (CN)

( * ) Notice: Subject to any disclaimer, the term of this patent is extended or adjusted under 35 U.S.C. 154(b) by 348 days.

(21) Appl. No.: 16/966,610

(22) PCT Filed: Jun. 1, 2018

(86) PCT No.: PCT/CN2018/089656
§ 371 (c)(1),
(2) Date: Jul. 31, 2020

(87) PCT Pub. No.: WO2019/148723
PCT Pub. Date: Aug. 8, 2019

(65) Prior Publication Data

US 2021/0024235 A1 Jan. 28, 2021

(30) Foreign Application Priority Data

Feb. 2, 2018 (CN) ..... 201810106643.2
Feb. 2, 2018 (CN) ..... 201810107686.2

(51) Int. Cl.
*B65B 13/02* (2006.01)
*B25B 25/00* (2006.01)
(Continued)

(52) U.S. Cl.
CPC ..... *B65B 13/027* (2013.01); *B25B 25/00* (2013.01); *B65B 13/185* (2013.01)

(58) Field of Classification Search
CPC ..... B65B 13/02; B65B 13/027; B65B 13/185; B65B 13/16; B65B 13/18; B65B 59/003;
(Continued)

(56) References Cited

U.S. PATENT DOCUMENTS 4,499,928 A * 2/1985 Furutsu ..... E04G 21/122 156/481
9,889,562 B1 2/2018 Rembisz

FOREIGN PATENT DOCUMENTS

CN 101604825 A 12/2009
CN 105415380 A 3/2016
(Continued)

OTHER PUBLICATIONS

English translate (JPH0789511A), retrieved date Aug. 17, 2022.*
(Continued)

*Primary Examiner* — Shelley M Self
*Assistant Examiner* — Mohammed S. Alawadi
(74) *Attorney, Agent, or Firm* — Dinsmore & Shohl LLP

(57) ABSTRACT

A slide block-based positioning mechanism and an automatic tie tool having the same. The slide block-based positioning mechanism includes a slide block and a guide rail. The slide block fits the guide rail. The guide rail limits five degrees of freedom of the slide block. The slide block slides in a length direction of the guide rail. A head portion of a tie is arranged at a predetermined position at the slide block. The slide block pushes the tie from the predetermined position to a tie installation position.

19 Claims, 17 Drawing Sheets

(51) Int. Cl.

| | |
|---|---|
| ***B65B 13/18*** | (2006.01) |
| ***B65B 13/16*** | (2006.01) |
| ***B65B 59/00*** | (2006.01) |
| ***B65B 59/04*** | (2006.01) |

(58) Field of Classification Search
CPC ..... B65B 59/04; B65B 13/04; B65B 13/06; B25B 25/00
USPC ..... 140/93.2, 93.4, 93.6, 49; 100/29, 34
See application file for complete search history.

(56) References Cited

FOREIGN PATENT DOCUMENTS

| | | | | |
|---|---|---|---|---|
| CN | 106002924 | A | | 10/2016 |
| CN | 107150832 | A | * | 9/2017 |
| CN | 107264551 | A | | 10/2017 |
| JP | H0789511 | A | * | 4/1995 |

OTHER PUBLICATIONS

FUYU FSL40 Linear Guide Rail Slide, retrieved date Aug. 18, 2022.*
English translate (CN107150832A), retrieved date Aug. 18, 2022.*
International Search Report and Written Opinion for International Patent Application No. PCT/CN2018/089656, dated Aug. 8, 2019.

* cited by examiner

SLIDE BLOCK-BASED POSITIONING MECHANISM AND AUTOMATIC TIE TOOL HAVING THE SAME

CROSS-REFERENCE TO RELATED APPLICATIONS

The present disclosure is a U.S. National Phase of International Application No. PCT/CN2018/089656, filed Jun. 1, 2018 and entitled "SLIDE BLOCK-BASED POSITIONING MECHANISM AND AUTOMATIC TIE TOOL HAVING SAME", which claims priority of Chinese Patent Application No. CN201810107686.2, filed with the Chinese Patent Office on Feb. 2, 2018, entitled "Automatic Tie Tool Having a Slider-based positioning mechanism", and Chinese Patent Application No. CN201810106643.2, filed with the Chinese Patent Office on Feb. 2, 2018, entitled "Automatic Tie Tool", the entire contents of which are incorporated herein by reference in their respective entireties.

TECHNICAL FIELD

The present disclosure relates to a slider-based positioning mechanism, and in particular to an automatic tie tool having a slider-based positioning mechanism and an automatic tie tool.

BACKGROUND ART

Conventional nylon ties (cable ties) have square heads. All the prior-art automatic tie tools applicable to conventional nylon ties implement automatic tying (or tie installation) operations by positioning the ties using the square heads of the ties, while one-piece fixing ties are widely used in cars, trains, motorbikes, and some other transport means. The one-piece fixing tie is a combination of a conventional tie function and an additional fixation feature at the head. The fixation feature of the head of the tie is used mainly for being fastened onto a frame of a vehicle or a housing of a household appliance. Common types of the head features of the one-piece fixing ties mainly include: a combined type of a fir-tree-shaped head plus butterfly or a fir-tree-shaped head plus wings, a combined type of an arrow head plus a butterfly or an arrow head plus wings, a flat-plate type with a locking hole, and so on. Because the heads of the one-piece fixing ties have irregular shapes and have a variety of shapes, it is difficult to position and automatically feed the one-piece fixing ties in automatic tools. The vast majority of the one-piece fixing ties are neither suitable for being loaded by vibratory bowl feeders nor being fed by tubes. None of the concepts and methods for design of the various automatic tie machines and tools that have been available are applicable to the automation of the one-piece fixing ties. Throughout the world, cable harnesses for transport means such as automobiles are tied by manual operations with low operating efficiency and with large labor intensity. According to the introduction of many large-scale multinational companies in the automotive cable harness industry, many multinational companies in the automotive cable harness industry have been trying to develop, alone or together with some famous tool manufacturers, an automatic tie tool suitable for one-piece fixing ties in the past thirty years in order to improve the efficiency of installation of the one-piece fixing ties and reduce to labor intensity, but their efforts for more than thirty years have not turned into success. Contacts or phone calls have been received from many large-scale multinational companies in the automotive industry and from famous multinational companies in the automotive cable harness industry between 2013 and 2017, for requesting the development of an automatic tie tool for one-piece fixing ties. The inventor of the present disclosure has developed a number design solutions of automatic tools that can be used in one-piece fixing ties upon conception for many years and multiple tests, but all the different design solutions involve: a slider-based positioning mechanism.

SUMMARY

One of the objects of the present disclosure is to solve the problems of positioning and feeding of a one-piece fixing tie in an automatic tying tool.

It is conceived and summarized that tools for one-piece fixing ties may be designed in a variety of different structural forms according to different loading modes: a mode of manually loading ties one by one, pre-storing multiple ties in a curved magazine or a flat magazine and manually pushing and loading one tie each time a tie has been installed, automatically loading a tie by a robotic arm, automatically loading a tie from a wheel-shaped magazine, or loading interconnected ties, but each of the above-mentioned designs requires the one-piece fixing tie to be pre-positioned in the automatic tie tool and then pushed to a tying operation position. One of the objects of the present disclosure is to provide an automatic tie tool having a slider-based positioning mechanism, which allows a tie to be pre-positioned and then pushes the tie to the tying operation position.

The present disclosure is implemented by the following technical solution: An automatic tie tool having a slider-based positioning mechanism, including a slider (or slide block) and a guide rail; wherein the guide rail is fixed to a frame, the slider is fitted to the guide rail, five spatial degrees of freedom of the slider are restricted by the guide rail, the slider is configured to slide in a lengthwise direction of the guide rail, a head of a one-piece fixing tie is pre-positioned onto the slider, and the slider slides along the lengthwise direction of the guide rail to push the one-piece fixing tie from the pre-positioned position to a tying operation position.

Further, the slider has a slider hole allowing the tie to pass therethrough. That is, the slider and the slider hole are essential elements in the process of automatic installation of one-piece fixing ties.

Further, a protrusion structure is designed to be provided on the slider or a profiled recess is made in the slider according to the head of the one-piece fixing tie, so that the head of the tie is caught or stuck therein in slightly tight-fitting manner by using the elasticity of a plastic material of the head of the tie, that is, the head of the one-piece fixing tie is positioned onto the slider.

Further, the convex ribs on the slider configured to fix the head of the one-piece fixing tie are either integrated with the slider, or split into multiple parts and fixed on the slider by using bolts or pins.

Further, the slider is driven by a cylinder, or by a belt, or by a screw-nut transmission pair, or by being pushed out by a spring and pulled back by a flexible cord, or by serially-connected multiple sets of four-bar mechanisms with an increased stroke, or by a toggle mechanism with an increased stroke, or by a rocker-slider mechanism with an increased stroke, or by a crank-slider mechanism with an increased stroke.

Further, the belt, or the screw-nut transmission pair, or the flexible cord, or the serially-connected four-bar mechanisms, or the toggle mechanism, or the rocker-slider mechanism, or the crank-slider mechanism is driven by pneumatic power or electric power.

Further, the slider and the guide rail are fitted with each other in a cross section which is in a rectangle shape, or a double circular or arcuate shape, or a triangle shape, or a splined shape, or a combination of the above-mentioned basic cross-sectional shapes.

Further, the mechanism including the slider and the guide rail is used in an automatic tie tool into which ties are loaded manually, or in an automatic tool into which ties are loaded by a robotic arm, or in an automatic tie tool into which ties are loaded from a curved or flat-type magazine, or in an automatic tie tool into which ties are loaded from a wheel-shaped magazine, or in an automatic tie tool using interconnected ties.

In particular, the present disclosure is not only applicable to automatic tying tools for one-piece fixing ties having irregularly-shaped heads, but also applicable to automatic tying tools for conventional nylon ties having regularly-shaped heads.

The present disclosure brings about the advantageous effects of, e.g.:

1. solving the problem of positioning of a one-piece fixing tie in an automatic tie tool; and 2. providing a design method solving an automated tying operation for the one-piece fixing tie.

Figure 1:
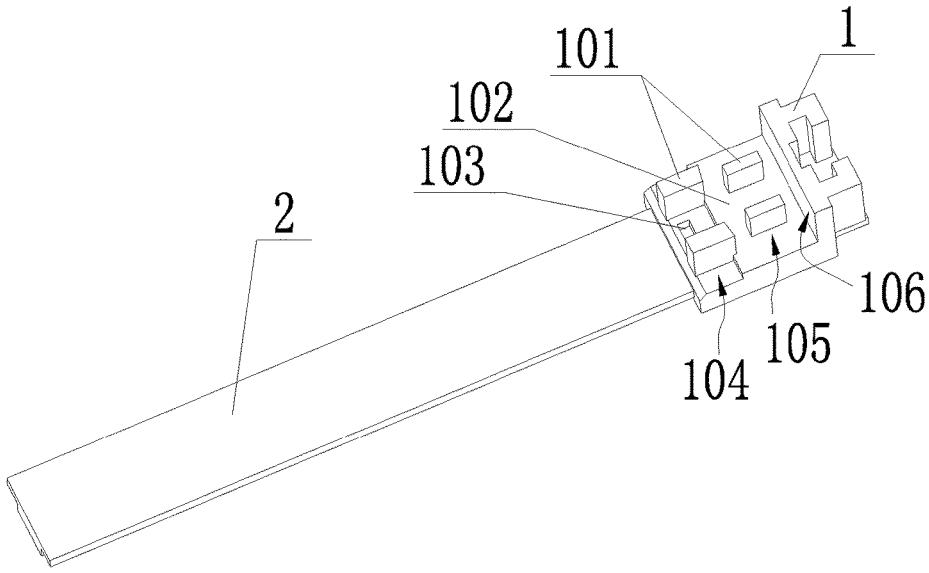
FIG. 1 is an axonometric view of a slider-based positioning mechanism according to an embodiment of the present disclosure.
Figure 2:
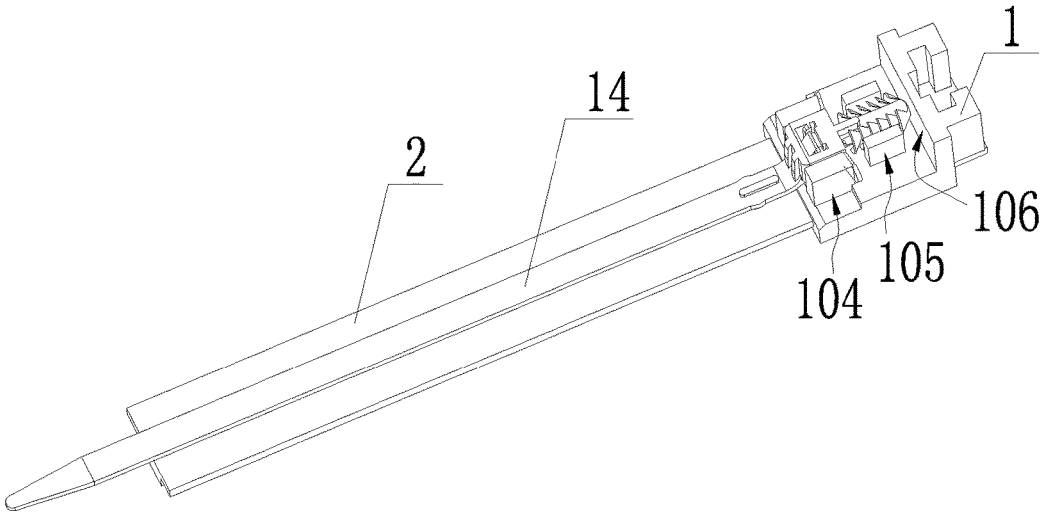
FIG. 2 is an axonometric view of a slider-based positioning mechanism in a state with a tie according to an embodiment of the present disclosure.
Figure 3:
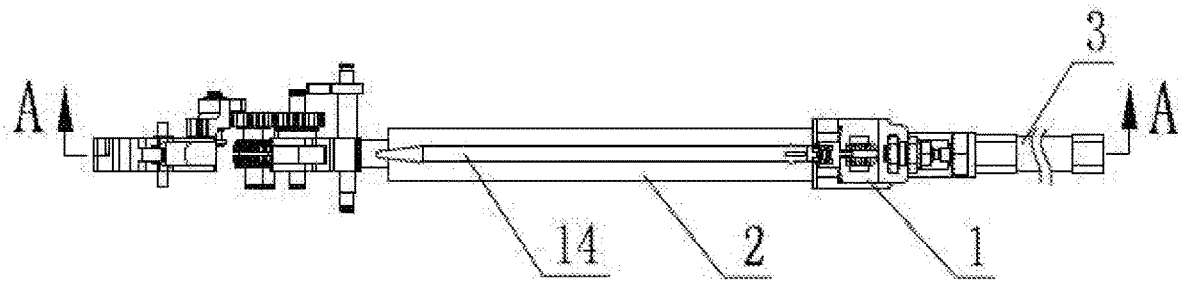
FIG. 3 is a top view of a slider-based positioning mechanism according to an embodiment of the present disclosure.
Figure 4:
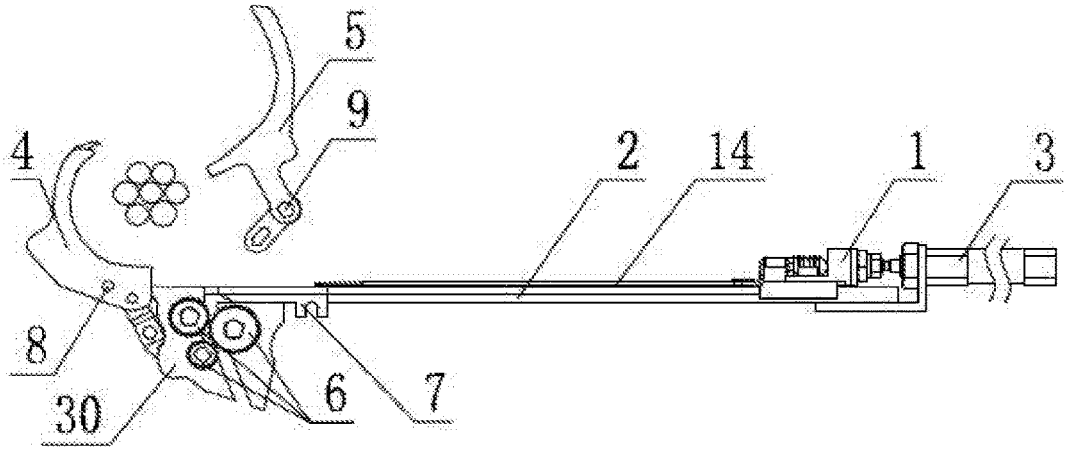
FIG. 4 is a front view of a slider-based positioning mechanism according to an embodiment of the present disclosure, wherein the slider is in a pre-positioned position.

Reference Numerals: 1—slider; 101—convex rib; 102—profiled recess; 103—slider hole; 104—first convex rib group; 105—second convex rib group; 106—stop wall; 2—guide rail; 3—cylinder; 4—first guide claw; 5—second guide claw; 6—tension roller; 7—cutoff blade; 202—tie connecting plate; 301—cut-off blade cylinder; 302—cut-off blade mandril; 303—toggle mechanism; 8—center pin for the first guide claw; 9—center pin for the second guide claw; 10—screw; 11—belt pulley; 12—belt; 13—toggle mechanism; 14—one-piece fixing tie; 15—central mounting shaft; 16—crank-link mechanism; 17—serially connected four-bar mechanism; 18—rocker or crank; 19—linkage; 20—curved or flat-type magazine; 21—wheel-shaped magazine; 22—pushing rod; 30—frame.

DETAILED DESCRIPTION OF EMBODIMENTS

In the description of the present disclosure, it should also be noted that the terms "disposed", "mounted", "coupled", and "connected" should be understood broadly unless otherwise expressly specified or defined. For example, a connection may be fixed connection or detachable connection or integral connection, may be mechanical connection or electric connection, or may be direct coupling or indirect coupling via an intermediate medium or internal communication between two elements. The specific meanings of the above-mentioned terms in the present disclosure can be understood by those of ordinary skill in the art according to specific situations.

The present disclosure will be further described below with reference to the accompanying drawings and embodiments.

First Embodiment

As shown in FIGS. 1, 2, 3, and 4, the slider (slide block) 1 is slidably fitted to the guide rail 2, five degrees of freedom of the slider 1 are restricted by the guide rail 2, and the slider 1 is slidable along the lengthwise direction of the guide rail 2. Convex ribs 101 are designed to be provided on the slider 1 or a profiled recess 102 is made in the slider 1 according to the head of a one-piece fixing tie 14, so that the head of the one-piece fixing tie 14 is caught or stuck therein in slightly tight-fitting manner by using the elasticity of a plastic material of the head of the one-piece fixing tie 14. The head of the one-piece fixing tie 14 is pre-positioned on the profiled recess 102 of the slider 1, and the slider 1 slides along the lengthwise direction of the guide rail 2 to push the tie from the pre-positioned position to a tying operation (i.e., tie installation) position.

In an embodiment of the present disclosure, a first convex rib group 104 and a second convex rib group 105 and a stop wall 106 are disposed on and protruded from the surface of the slider 1, and each of the first convex rib group 104 and the second convex rib group 105 includes two convex ribs 101. Each convex rib 101 may also be referred to as a protrusion, a bump, a projection, or the like, which means a portion protruding from the surface of the slider. Here, the first convex rib group 104 is close to the edges of the slider, and the second convex rib group 105 is close to the middle portion of the slider. Two convex ribs 101 of the first convex rib group 104 are disposed spaced apart and a first mounting space is formed between the two convex ribs 101; two convex ribs 101 of the second convex rib group 105 are disposed spaced apart and a second mounting space is formed between these two convex ribs 101; the first mounting space and the second mounting space communicate with each other in the lengthwise direction of the guide rail 2. The first convex rib group 104 and the stop wall 106 cooperate with each other to limit the position of the head of the tie in the lengthwise direction of the guide rail 2; both the first convex rib group 104 and the second convex rib group 105 can limit the position of the head of the tie in a direction perpendicular to the lengthwise direction of the guide rail 2.

Further, the protrusion structure of the slider 1 is provided with a stop wall 106, wherein the stop wall 106 is close to the second convex rib group 105 so as to block a movement of the one-piece fixing tie 14 in the lengthwise direction of the guide rail 2. The direction in which the tie is pushed from the pre-positioned (predetermined) position to the tying operation (tie installation) position is set as a first direction, and a direction opposite to the first direction is set as a second direction. After the head of the one-piece fixing tie 14 is stuck in the first mounting space and the second mounting space, the first function of the stop wall 106 is to block a movement of the head of the one-piece fixing tie 14 in the second direction. The second function of the stop wall 106 is to keep the one-piece fixing tie 14 in place on the slider 1.

Further, the first convex rib group 104, the second convex rib group 105, and the stop wall 106 may be replaced with a profiled recess 102 provided in the surface of the slider 1.

Further, the positions of the convex ribs 101 and the stop wall 106, and the sizes of the first mounting space and the second mounting space are set according to the shape and size of the corresponding head of the one-piece fixing tie 14, and the convex ribs 101 and the stop wall 106 cooperate with each other to fix the head of the one-piece fixing tie 14 onto the slider 1; or the convex ribs 101 and the stop wall 106 are replaced with the profiled recess 102, the profiled recess 102 is sized according to the corresponding head of the one-piece fixing tie 14 such that the head of the one-piece fixing tie 14 is fixed onto the slider 1. In an embodiment of the present disclosure, a slider hole 103 is further recessed in a surface part of the slider 1 where the first convex rib group 104 is located. The position of the slider hole 103 corresponds to the position of a hole in the head of the one-piece fixing tie 14, and matches in shape and size with a tail of the one-piece fixing tie 14. That is to say, the tail of the one-piece fixing tie 14 can pass through the hole in the head of the one-piece fixing tie 14 and through the slider hole 103.

The convex ribs 101 on the slider 1 for fixing the head of the one-piece fixing tie 14 may alternatively be split into multiple parts and fixed to the slider 1 by using bolts or pins, and the guide rail 2 is fixed to a frame 30. In other words, each convex rib 101 may be formed integrally with or detachably connected with the slider 1, and for example, the convex rib 101 and the slider 1 may be connected with each other by bolts or pins.

Further, the slider 1 is provided with a power introducing portion near the stop wall 106. The power introducing portion is configured to be connected with a power mechanism such as a cylinder or the like. The power introducing portion is provided with an engagement groove having an opening facing the second direction and an opening perpendicular to the surface of the slider 1.

Second Embodiment

Figure 5:
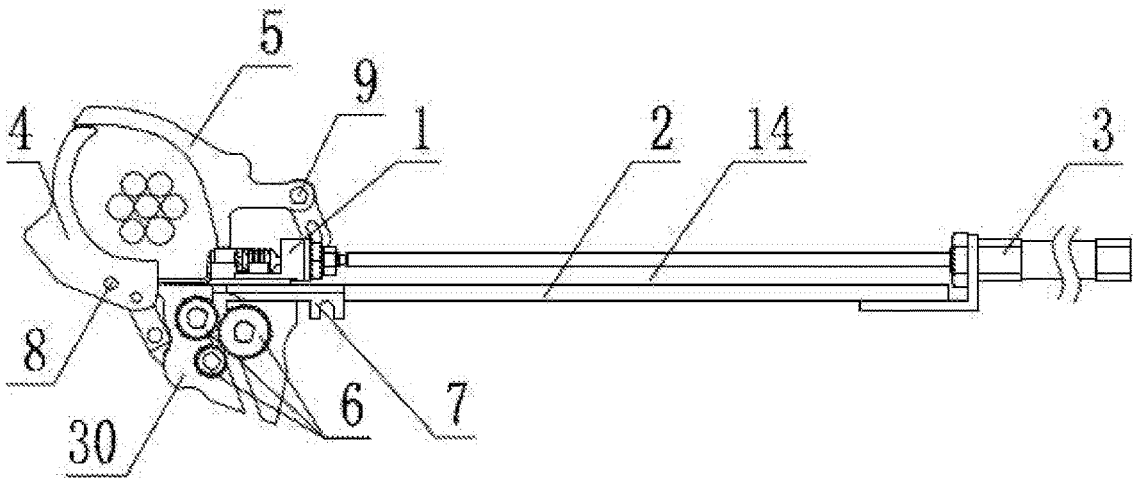
FIG. 5 is a front view of a slider-based positioning mechanism according to an embodiment of the present disclosure, wherein the slider is in a tying operation position and the tying is started.
Figure 6:
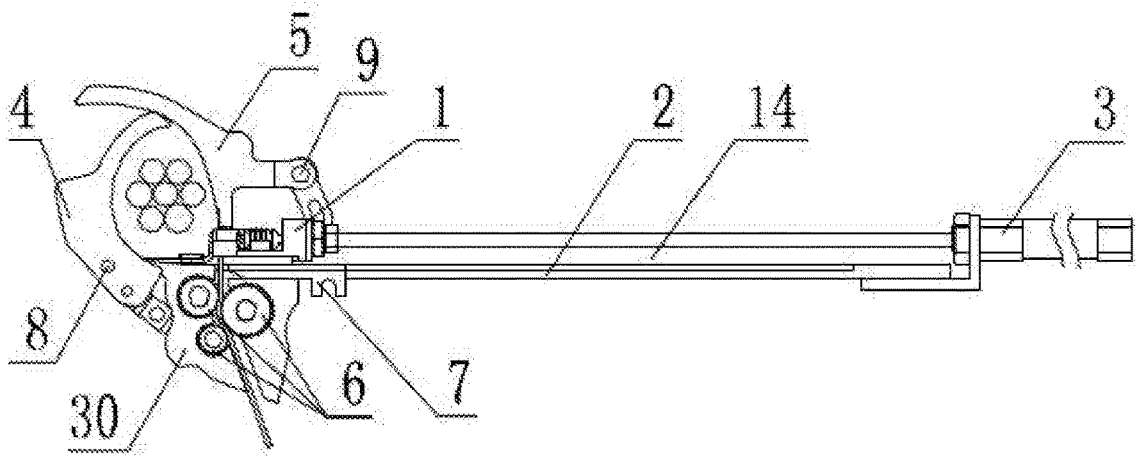
FIG. 6 is a front view of a slider-based positioning mechanism according to an embodiment of the present disclosure, wherein the slider is in a tying operation position and the tying process is being performed.
Figure 7:
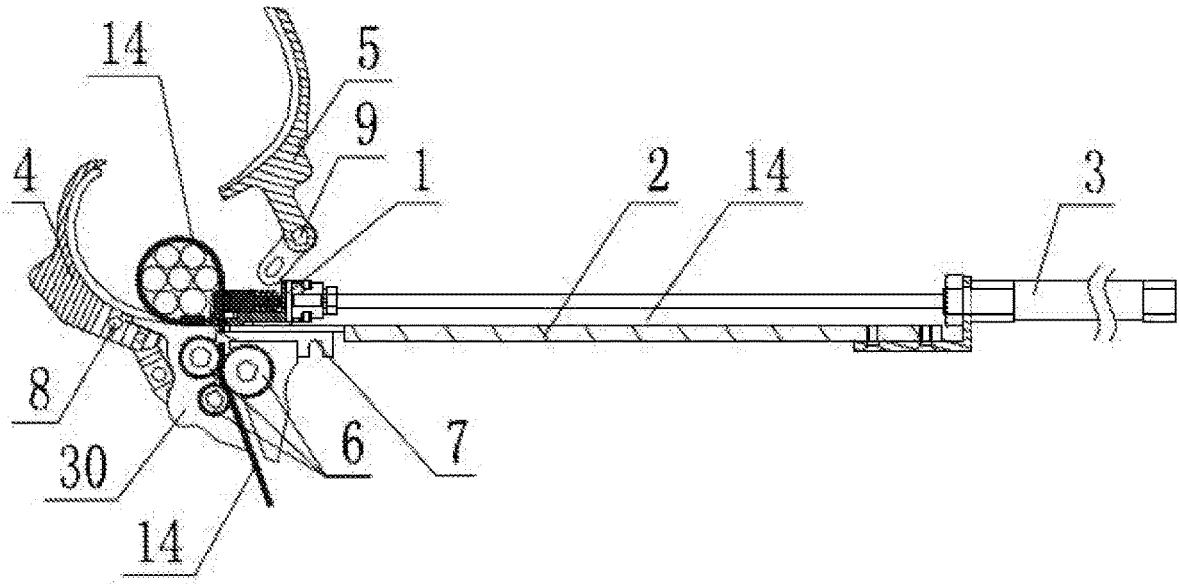
FIG. 7 is a front view of the slider-based positioning mechanism according to an embodiment of the present disclosure, wherein the slider is in a tying operation position, the tying is completed, and the head of the tie is about to be withdrawn from the slider.

As shown in FIGS. 5, 6, and 7, further, in an embodiment of the present disclosure, a center pin 8 for a first guide claw, a center pin 9 for a second guide claw, tension rollers 6, and a cut-off blade 7 are mounted on the frame 30.

As shown in FIGS. 30, 31, 32, 33, 34, 35, and 36, a cut-off blade 7 is additionally mounted onto the slider 1 for separating the one-piece fixing tie 14 from a tie connecting plate 202, the cut-off blade 7 is configured to slide up and down on the slider 1, such that the cut-off blade 7 moves along with the slider 1. In this case, the cut-off blade 7 is not only configured to separate the interconnected ties from the tie connecting plate 202, the cut-off blade 7 also serves the positioning function in place of the stop wall 106; or the cut-off blade 7 is mounted onto a pushing rod (charging ram) 22 and slides up and down along with the pushing rod 22. For discrete ties, it is unnecessary to mount the cut-off blade 7.

In this embodiment, a driving member for driving the cut-off blade 7 to mobe may be a cut-off blade cylinder 301. Specifically, a piston rod of the cut-off blade cylinder 301 is fixedly provided with a cut-off blade mandril (or jack ejector pin) 302. When the piston rod of the cut-off blade cylinder 301 extends out, the cut-off blade mandril 302 is jacked out so as to drive the cut-off blade 7 to move to achieve the separation of the ties. The cut-off blade 7 is movably mounted on the slider 1, and the cut-off blade mandril 302 is designed to be detachable from the cut-off blade 7. The slider 1 usually has two operation positions, i.e., the pre-positioned position and the tying operation position as mentioned above. When the slider 1 is in the pre-positioned position, the cut-off blade mandril 302 can act on the cut-off blade 7 and be automatically reset after the separation of the ties is completed. The cut-off blade 7 can move together with the slider 1 from the pre-positioned position to the tying operation position.

Figure 36:
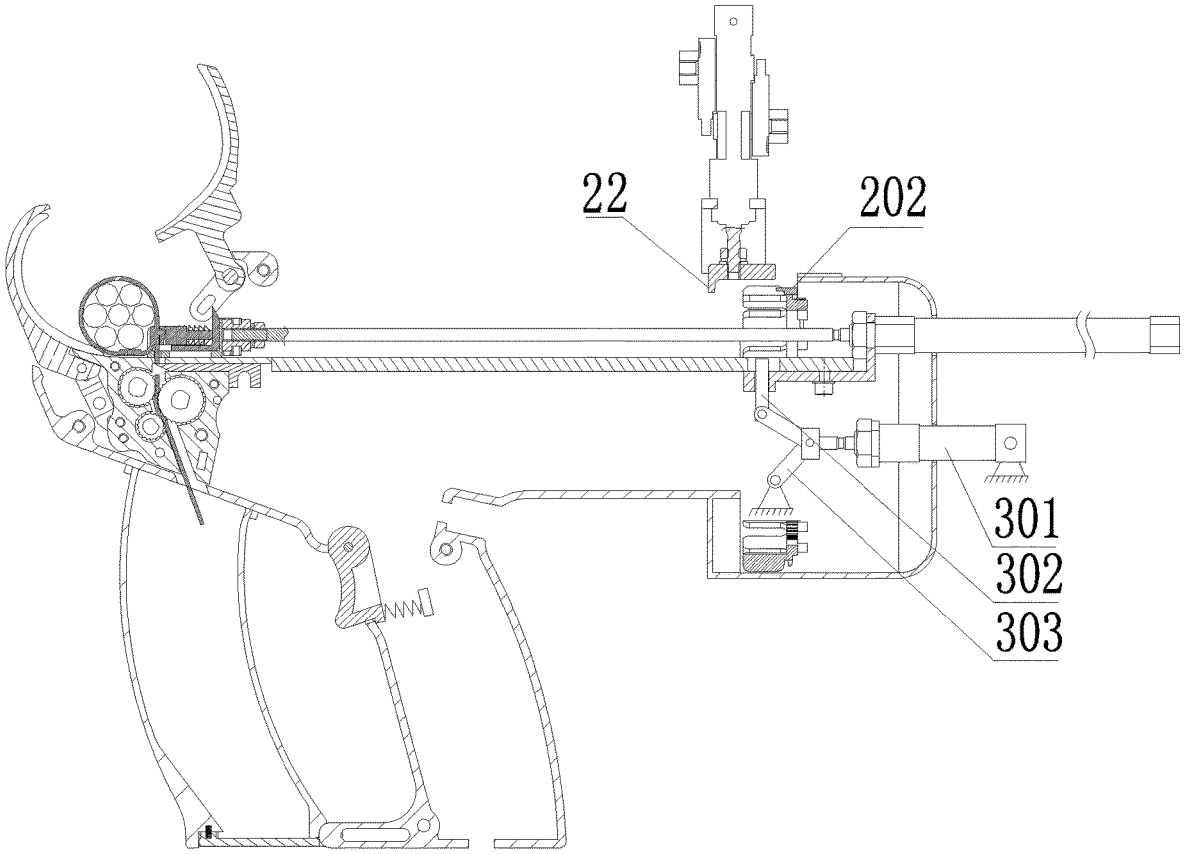
FIG. 36 is a schematic sectional view of the automatic tie tool according to an embodiment of the present disclosure, wherein the cut-off blade is driven by using a combination of a toggle mechanism and a cylinder.

With continued reference to FIG. 36, in this embodiment, a toggle mechanism 303 may further be arranged between the piston rod of the cut-off blade cylinder 301 and the cut-off blade 7. With such arrangement, the cut-off blade 7 is added, so that each one-piece fixing tie 14 of the interconnected ties can be reliably and quickly cut from the tie connecting plate 202, whereby the working reliability of the automatic tie tool in this embodiment is improved.

With continued reference to FIG. 36, in this embodiment, the cut-off blade cylinder 301 is horizontally disposed, and the toggle mechanism 303 is connected between the piston rod of the cut-off blade cylinder 301 and the cut-off blade mandril 302, wherein the piston rod is extended and retracted in the horizontal direction, and the cut-off blade mandril 302 is moved in the upward and downward direction. Such arrangement greatly reduces the longitudinal space occupied by the housing, enabling the automatic tie tool to have a more compact overall structure.

A first guide claw 4 is rotatably connected with the center pin 8 for the first guide claw, that is, the first guide claw 4 is rotatable about the center pin 8 for the first guide claw. The second guide claw 5 is rotatably connected with the center pin 9 for the second guide claw, that is, the second guide claw 5 is rotatable about the center pin 9 for the second guide claw. A guide channel is formed by the first guide claw 4 and the second guide claw 5. The first guide claw 4 has a first guide surface providing a guiding-in direction substantially flush with the lengthwise direction of the guide rail 2. While the slider 1 is sliding along the lengthwise direction of the guide rail 2 to push the tie from the pre-positioned position to the tying operation position, the tail of the one-piece fixing tie 14 enters the guide channel formed by the first guide claw 4 and the second guide claw 5. The second guide claw 5 has a second guide surface providing a guiding-out direction allowing passage through the hole of the head of the one-piece fixing tie 14 when it is in the tying operation position. When the slider 1 is pushed to the tying operation position, the tail of the one-piece fixing tie 14 approaches the hole of the head of the one-piece fixing tie 14. The first guide claw 4 rotates about the center pin 8 for the first guide claw such that the tail of the one-piece fixing tie 14 passes through the hole of the head of the one-piece fixing tie 14 and through the slider hole 103 of the slider 1 and is clamped by the tension rollers 6, the tension rollers 6 rotate to tighten the one-piece fixing tie 14, the cut-off blade 7 cuts off the tail of the one-piece fixing tie 14, the head of the one-piece fixing tie 14 is withdrawn from the slider 1, and the slider 1 moves back to the pre-positioned position.

Third Embodiment

As shown in FIGS. 3, 4, 5, 6, and 7, the reciprocating movement of the slider 1 is driven directly by the cylinder 3. Further, in an embodiment of the present disclosure, the power mechanism for the slider 1 includes a cylinder 3, wherein the cylinder body of the cylinder 3 is fixed to the end of the guide rail via an L-shaped cylinder mounting plate. An extendable rod of the cylinder 3 is connected with the power introducing portion of the slider 1.

Figure 8:
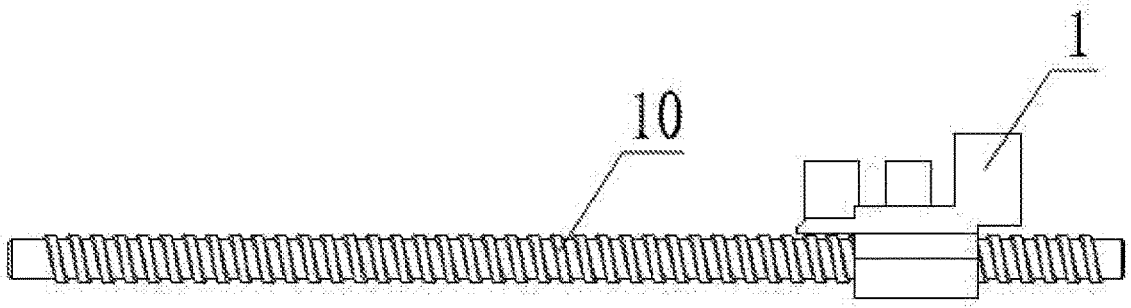
FIG. 8 is a front view of a slider-based positioning mechanism according to an embodiment of the present disclosure, wherein the slider is driven by a screw.

As shown in FIG. 8, the reciprocating movement of the slider 1 is driven by a screw 10. Further, in an embodiment of the present disclosure, the power mechanism for the slider 1 may include a screw 10 and a stepper motor configured to drive the screw 10 to rotate. While the slider 1 is slidably connected with the guide rail 2, the slider 1 is also threadedly connected with the screw 10. This threaded connection allows the rotation of the screw 10 to be converted into the reciprocating movement of the slider 1. For example, the slider 1 moves in the first direction when the screw 10 rotates forward, and the slider 1 moves in the second direction when the screw 10 rotates reversely, and vice versa.

Figure 9:
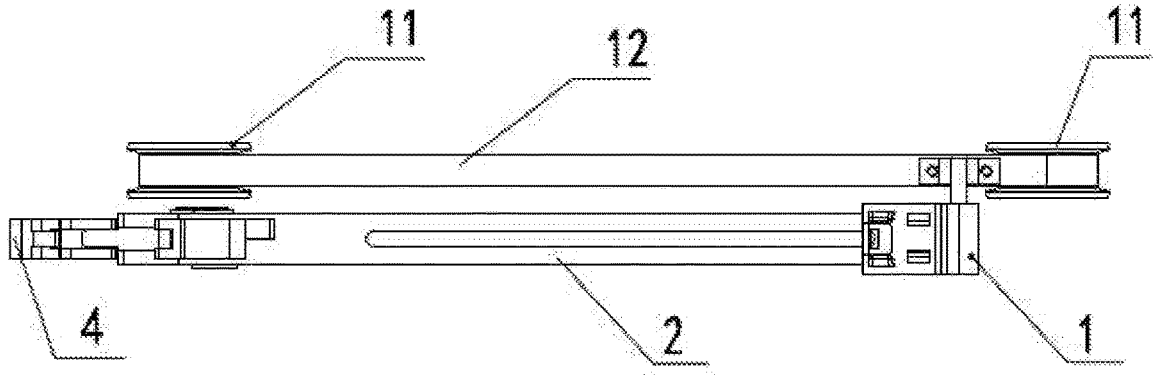
FIG. 9 is a top view of a slider-based positioning mechanism according to an embodiment of the present disclosure, wherein the slider is driven by a belt.
Figure 10:
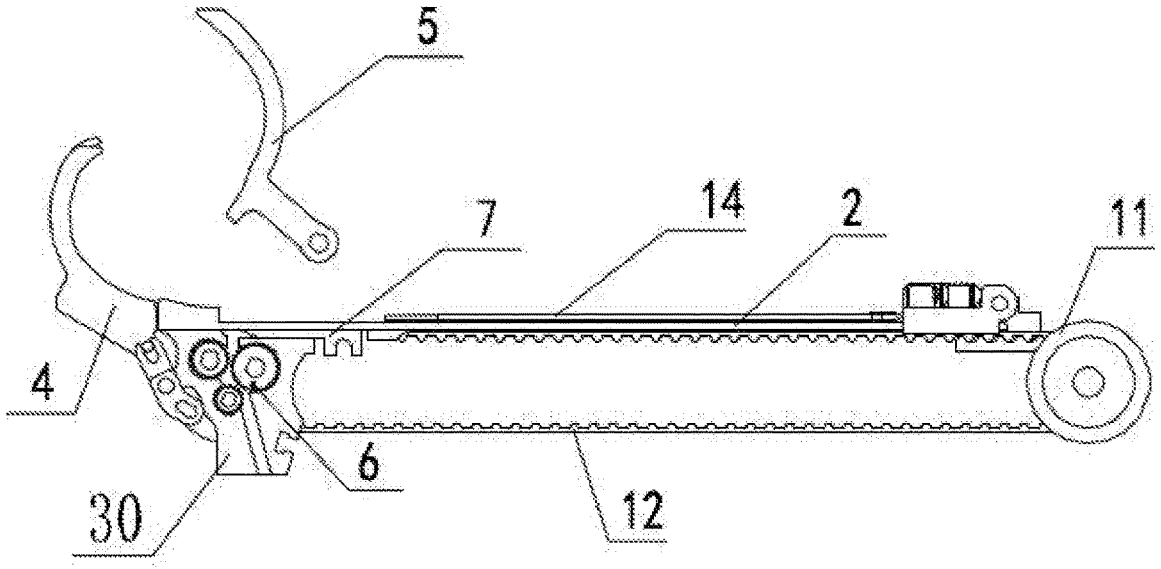
FIG. 10 is a front view of a slider-based positioning mechanism according to an embodiment of the present disclosure, wherein the slider is driven by a belt.

As shown in FIGS. 9 and 10, a belt 12 is driven by belt pulleys 11, wherein the belt 12 is coupled to the slider 1, and the belt 12 drives the reciprocating movement of the slider 1. Further, in an embodiment of the present disclosure, the power mechanism for the slider 1 includes belt pulleys 11 and a belt 12. The belt 12 is tensioned by the belt pulleys 11 and the belt 12 is drivingly connected with the belt pulleys 11. At least two belt pulleys 11 are provided, wherein at least one of which is a driving pulley, and the power required for the movement of the belt 12 is input mainly by the driving pulley. For example, a motor may be provided to be drivingly connected with the driving pulley. The belt pulleys 11 and the belt 12 may be mounted on a side of the guide rail 2. The belt 12 is connected with the slider 1 so that the slider 1 is movable synchronously with the belt 12.

Figure 11:
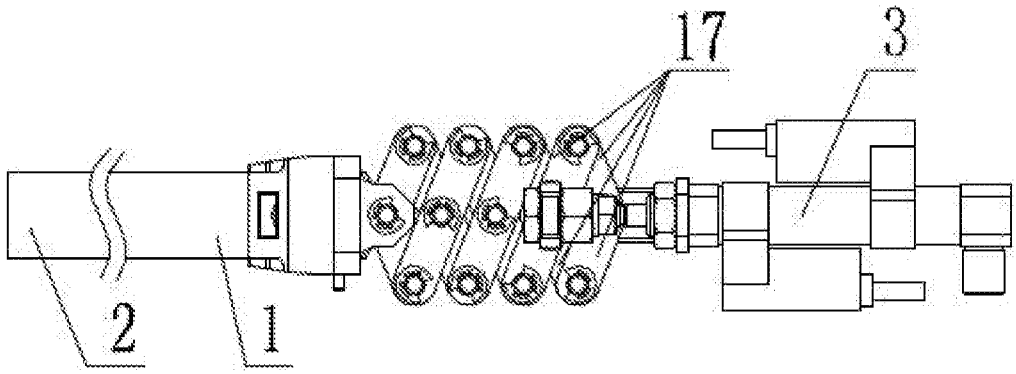
FIG. 11 is a top view of a slider-based positioning mechanism according to an embodiment of the present disclosure, wherein the slider is driven by a combination of multiple sets of four-bar mechanisms to achieve an increased stroke.
Figure 12:
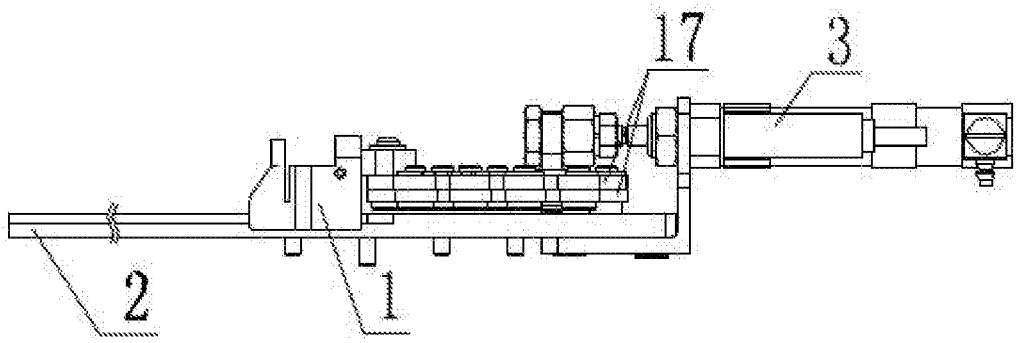
FIG. 12 is a front view of a slider-based positioning mechanism according to an embodiment of the present disclosure, wherein the slider is driven by a combination of multiple sets of four-bar mechanisms.
Figure 13:
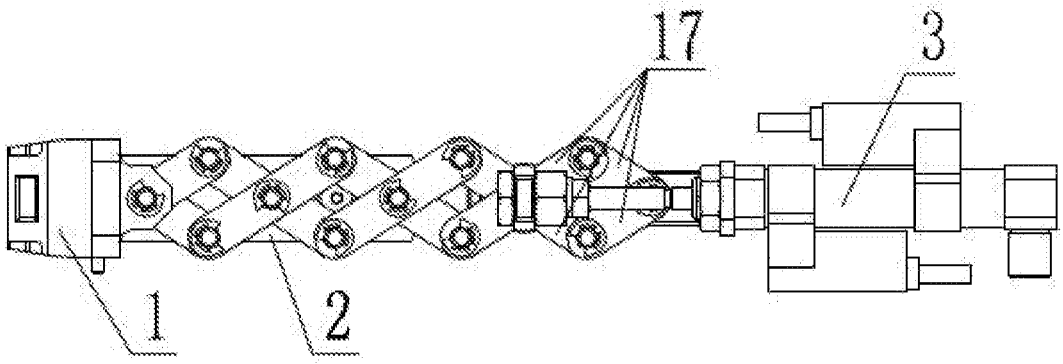
FIG. 13 is a top view of a slider-based positioning mechanism according to an embodiment of the present disclosure, wherein the slider is driven by a combination of multiple sets of four-bar mechanisms, and the slider is in a tying operation position.

As shown in FIGS. 11, 12, and 13, the slider 1 is driven by a combination of multiple sets of four-bar mechanisms and a cylinder 3 to achieve an increased stroke. Further, in an embodiment of the present disclosure, the power mechanism for the slider 1 includes a four-bar mechanism and a cylinder 3. The four-bar mechanism has at least a hinged point and has two hinged points in the lengthwise direction of the guide rail 2, wherein one of the two hinged points is connected with the guide rail 2 or the cylinder body of the cylinder 3, and the other hinged point is connected with the extendable rod of the cylinder 3. When the extendable rod extends out, the four-bar mechanism is stretched in the lengthwise direction of the guide rail 2; when the extendable rod is retracted, the four-bar mechanism is shortened in the lengthwise direction of the guide rail 2. Further, multiple sets of four-bar mechanisms may be provided in order to increase the stroke of the four-bar mechanism. Further, optionally, the cylinder 3 may be replaced with a crank linkage or a cam driven by an electric motor.

Figure 14:
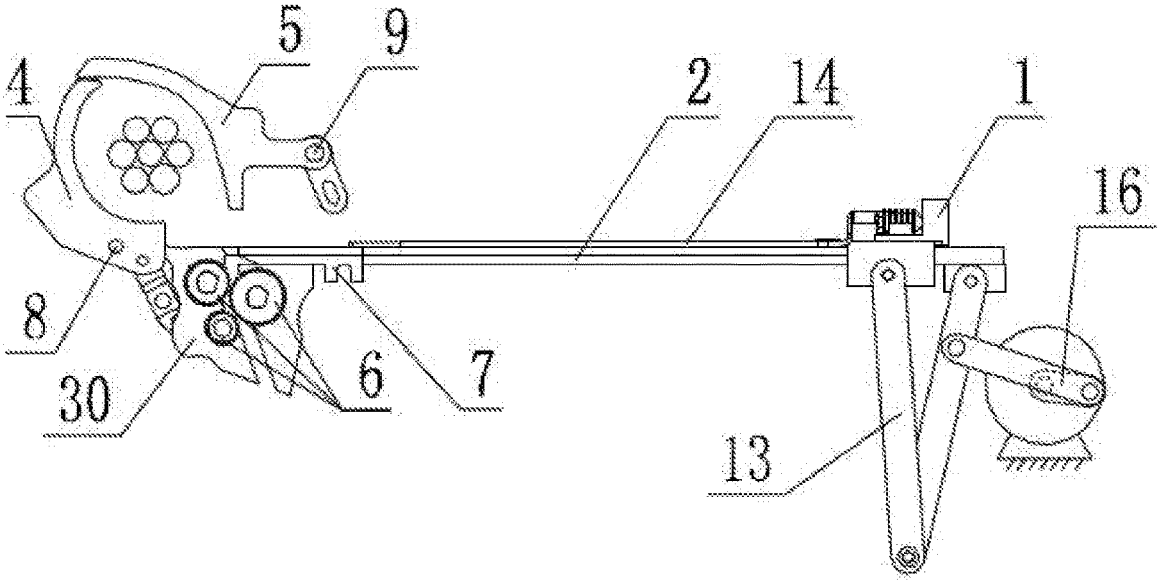
FIG. 14 is a front view of a slider-based positioning mechanism according to an embodiment of the present disclosure, wherein the slider is driven by using a combination of a crank-link mechanism and a toggle mechanism.

As shown in FIG. 14, a crank-link mechanism 16 driven by a motor is used in combination with a toggle mechanism 13 to drive the slider 1 to slide on the guide rail 2. Further, in an embodiment of the present disclosure, the power mechanism for the slider 1 includes a crank-link mechanism 16 and a toggle mechanism 13. Here, the toggle mechanism 13 includes a first linkage and a second linkage, wherein the first linkage has one end hinged with the second linkage, and the other end hinged with the slider 1; and the second linkage has one end hinged with the guide rail 2, and the other end hinged with the first linkage. A power output portion of the crank-link mechanism 16 is rotatably connected with the second linkage. When the crank-link mechanism 16 is moving, the second linkage can be driven to swing, whereby an angle of opening of the toggle mechanism 13 is changed to enable the slider 1 to be driven to slide on the guide rail 2.

Figure 15:
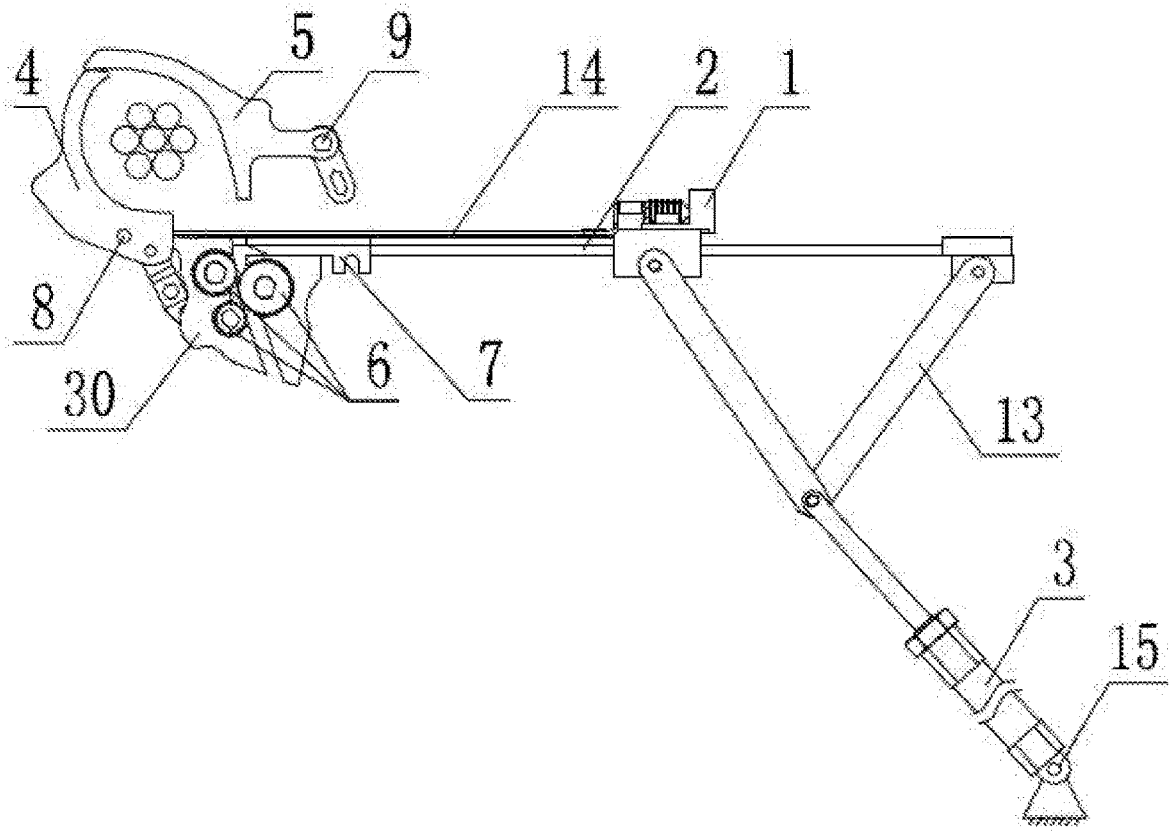
FIG. 15 is a front view of a slider-based positioning mechanism according to an embodiment of the present disclosure, wherein the slider is driven by using a combination of a cylinder and a toggle mechanism.

As shown in FIG. 15, a cylinder 3 is used in combination with a toggle mechanism 13 to drive the slider 1 to slide on the guide rail 2, the cylinder 3 is mounted to a central mounting shaft 15, wherein the cylinder 3 is rotatable about the central mounting shaft 15. Further, in an embodiment of the present disclosure, the power mechanism for the slider 1 includes a cylinder 3 and a toggle mechanism 13. Here, the toggle mechanism 13 includes a first linkage and a second linkage, wherein the first linkage has one end hinged with the second linkage, and the other end hinged with the slider 1; and the second linkage has one end hinged with the guide rail 2, and the other end hinged with the first linkage. Further, the cylinder body of the cylinder 3 is rotatably connected with the central mounting shaft 15, and the extendable rod of the cylinder 3 is rotatably connected at a joint between the first linkage and the second linkage.

Figure 16:
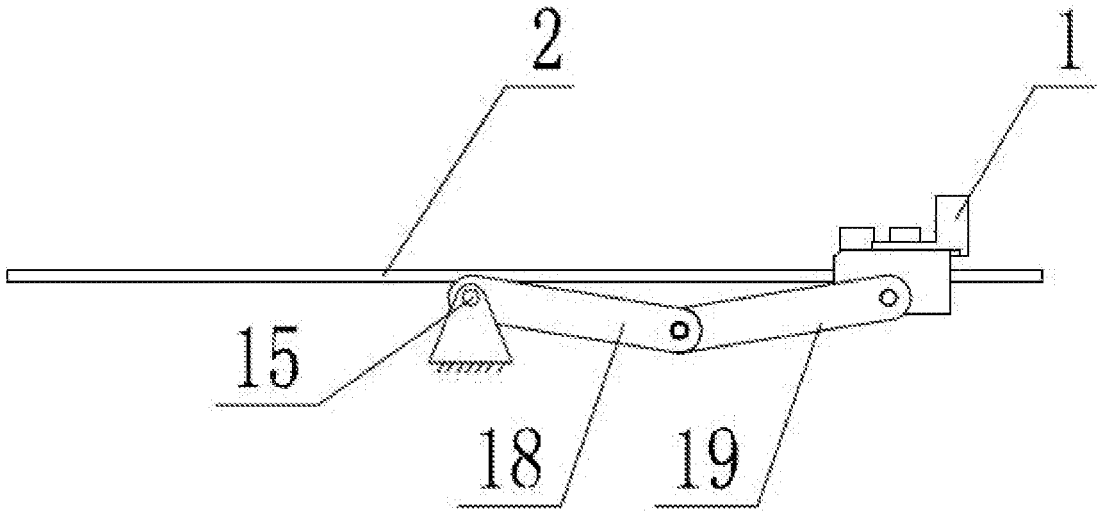
FIG. 16 is a front view of a slider-based positioning mechanism according to an embodiment of the present disclosure, wherein the slider is driven by using a stroke-increasing rocker mechanism or a stroke-increasing crank mechanism.
Figure 17:
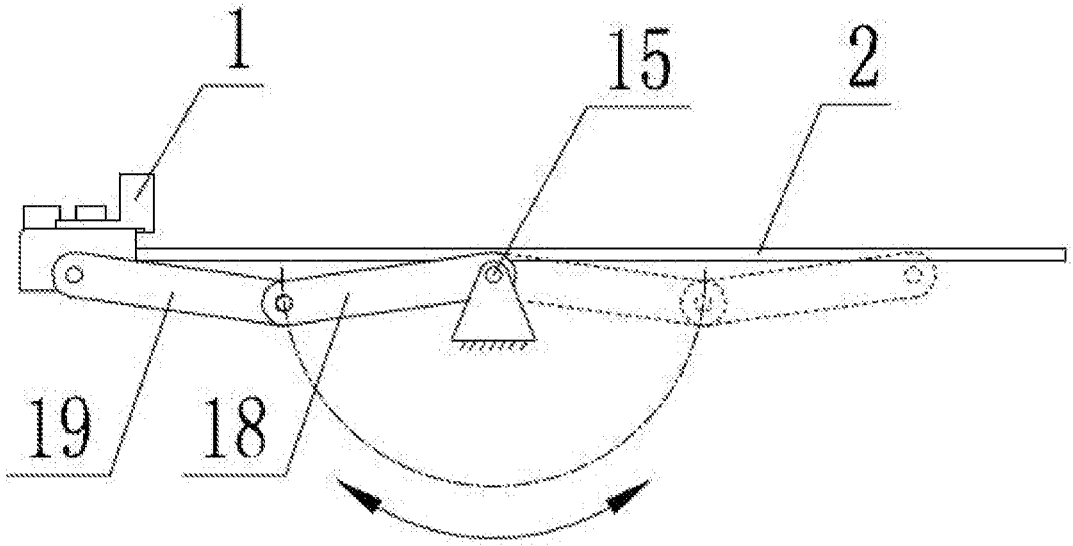
FIG. 17 is a front view of a slider-based positioning mechanism according to an embodiment of the present disclosure, wherein the slider is driven by using a stroke-increasing rocker mechanism or a stroke-increasing crank mechanism, and the slider is in a tying operation position.
Figure 18:
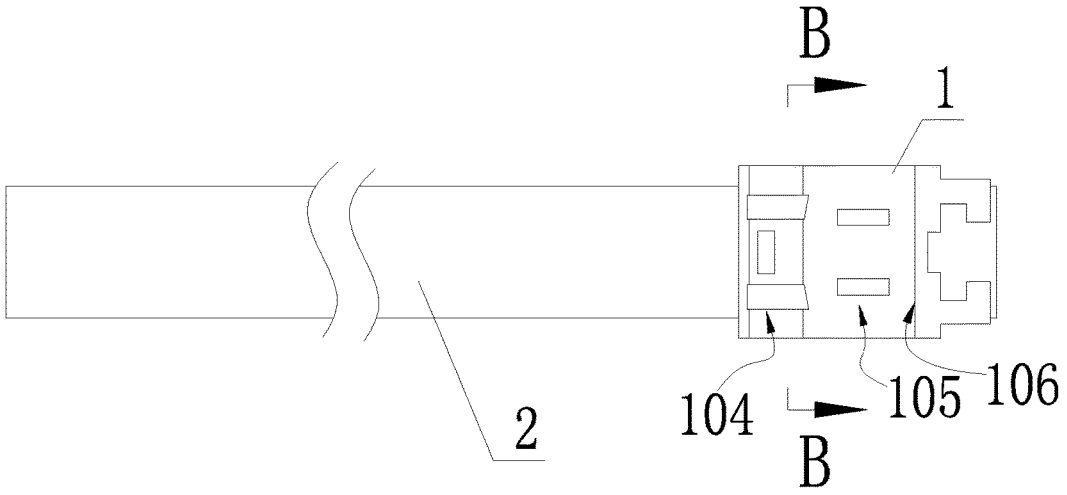
FIG. 18 is a front view of a slider-based positioning mechanism according to an embodiment of the present disclosure, wherein the slider and a guide rail are fitted to each other in a rectangular cross-section.
Figure 19:
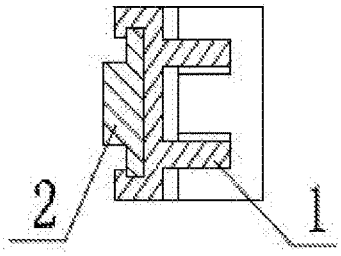
FIG. 19 is a sectional view taken along B-B corresponding to FIG. 18.
Figure 20:
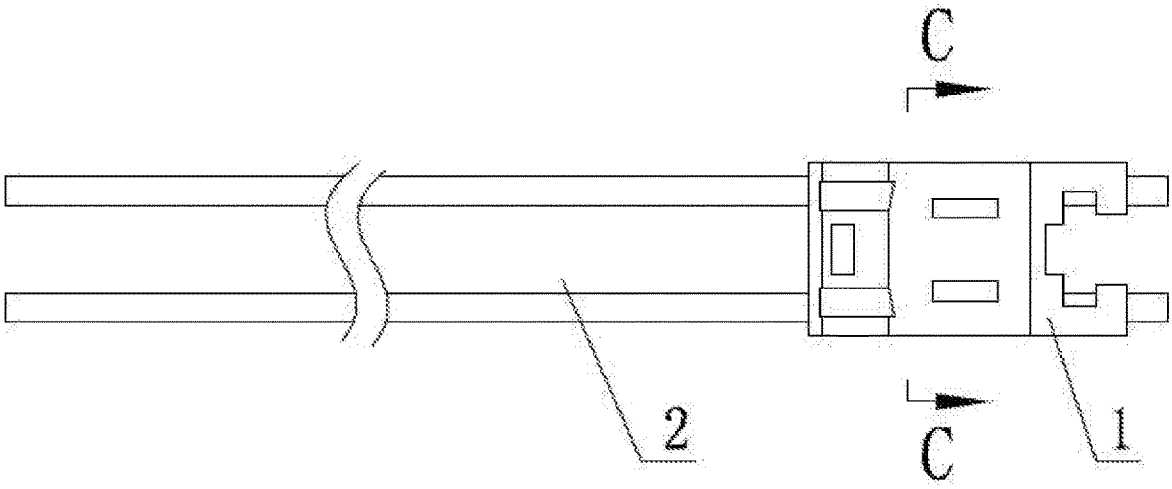
FIG. 20 is a front view of a slider-based positioning mechanism according to an embodiment of the present disclosure, wherein the slider and a guide rail are fitted to each other in a double circular cross-section.
Figure 21:
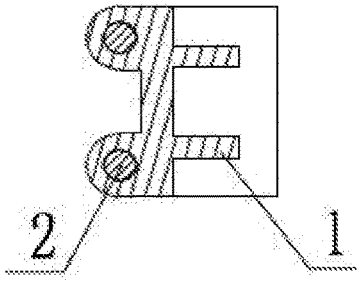
FIG. 21 is a sectional view taken along C-C corresponding to FIG. 20.
Figure 22:
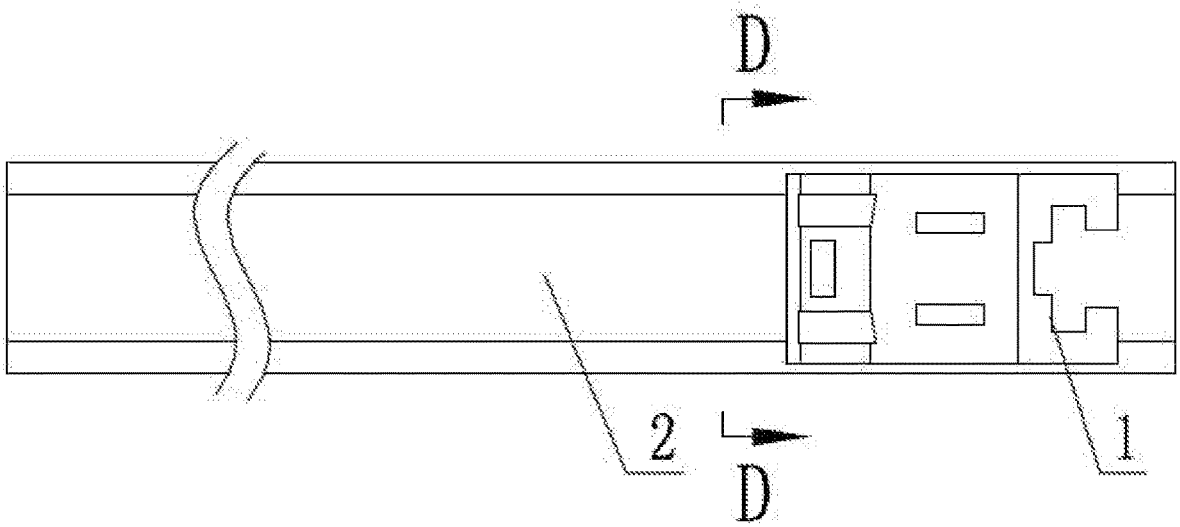
FIG. 22 is a front view of a slider-based positioning mechanism according to an embodiment of the present disclosure, wherein the slider and a guide rail are fitted to each other in a triangular cross-section.
Figure 23:
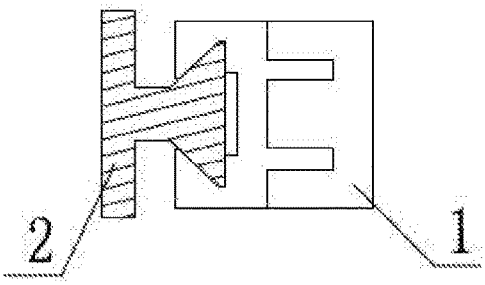
FIG. 23 is a sectional view taken along D-D corresponding to FIG. 22.
Figure 24:
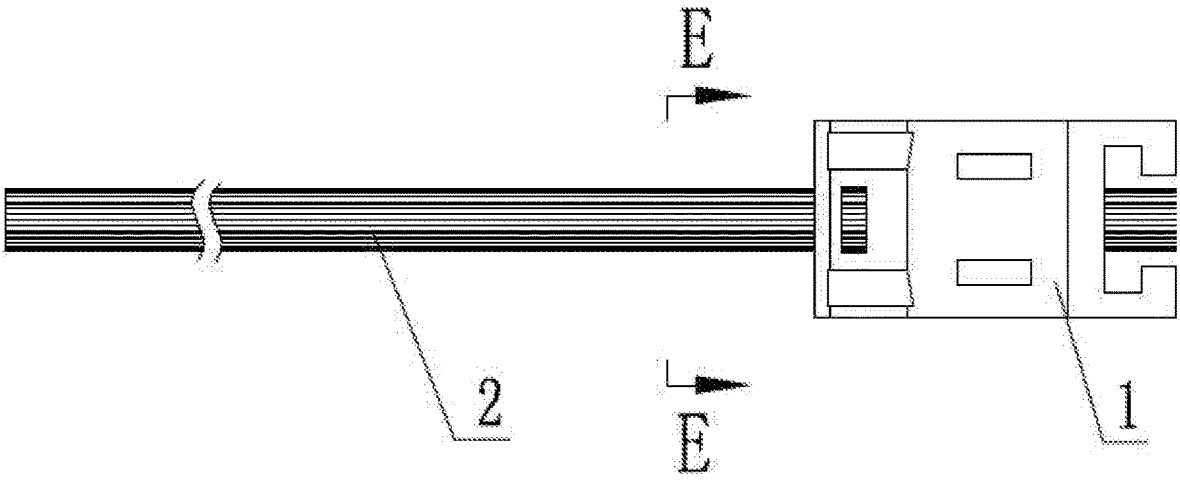
FIG. 24 is a front view of an embodiment of the present disclosure, wherein the slider and a guide rail are fitted to each other in a splined cross-section.
Figure 25:
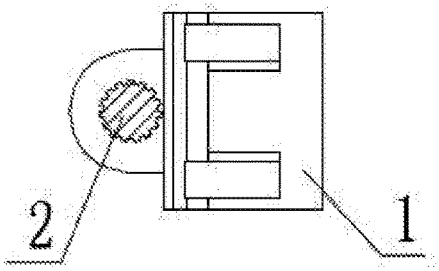
FIG. 25 is a sectional view taken along E-E corresponding to FIG. 24.

As shown in FIGS. 16 and 17, the slider 1 is driven by using a rocker or crank 18 and the linkage 19. The slider 1 runs from the pre-positioned position through the dead center of the rocker or crank 18 to the tying operation position. When the tying is completed, the rocker or crank 18 and the linkage 19 drive the slider 1 to move back to the pre-positioned position through the dead center position, whereby a stroke increasing effect is achieved.

Fourth Embodiment

As shown in FIGS. 18, 19, 20, 21, 22, 23, 24, and 25, the guide rail 2 and the slider 1 are fitted with each other in a rectangular cross-section, or in a double circular cross-section, or in a triangular cross-section, or in a spline fit, or in a form of a combination of the above-mentioned basic shapes. The guide rail 2 restricts five spatial degrees of freedom of the slider 1, and the slider 1 is only allowed to reciprocate in the lengthwise direction of the guide rail 2. The slider 1 is configured to have a groove-shaped or hole-shaped slidable fitting portion which is slidably fitted to the guide rail 2, wherein the guide rail 2 is mounted to the slidable fitting portion. The portion of the guide rail 2 fitted with the slider 1 has a cross section perpendicular to the lengthwise direction of the guide rail, wherein the cross section is in a rectangle, or a double circular or arcuate shape, or a triangle, or a splined shape, or a combination of the above-mentioned basic cross-sectional shapes.

Fifth Embodiment

Figure 26:
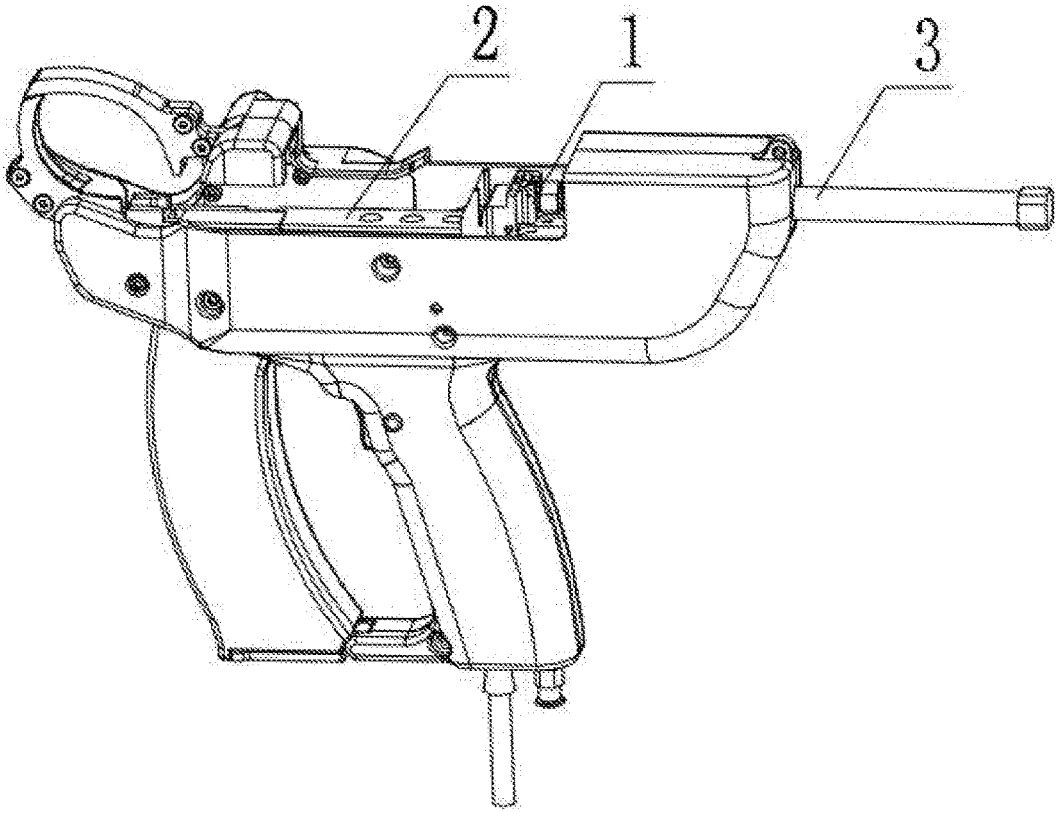
FIG. 26 is an axonometric view of a slider-based positioning mechanism according to an embodiment of the present disclosure, which is utilized in a manual or robotic loading mode with one belt loaded at a time.

As shown in FIG. 26, the embodiment of the present disclosure is utilized in a manual or robotic loading mode with one belt loaded at a time. When the slider 1 is in the pre-positioned position, the head of one of the one-piece fixing ties 14 is stuck into the slider 1 manually or by a robotic arm at a time, the slider 1 pushes the one-piece fixing tie 14 to the tying operation position, and the slider 1 moves back to the pre-positioned position after the tying is completed.

Sixth Embodiment

Figure 27:
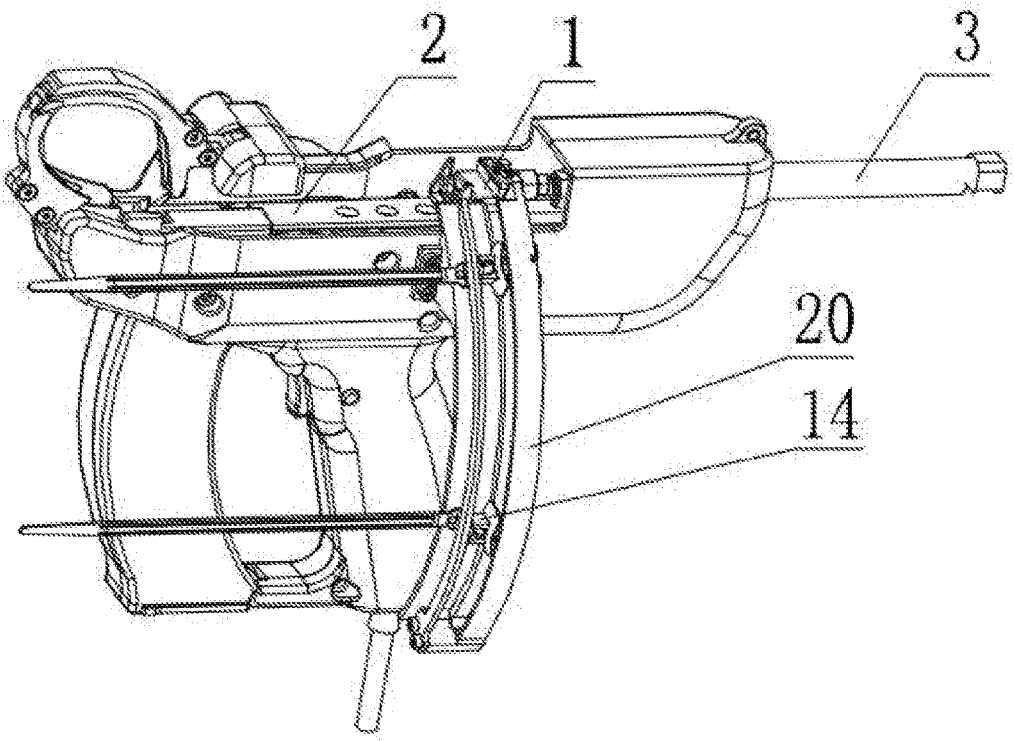
FIG. 27 is an axonometric view of a slider-based positioning mechanism according to an embodiment of the present disclosure, which is utilized in a loading mode using a curved or flat-type magazine.

FIG. 27 shows a case where the embodiment of the present disclosure is utilized in an automatic tie tool with a curved or flat-type magazine 20 for one-piece fixing ties 14. When the slider 1 is in the pre-positioned position, one of the one-piece fixing ties 14 is pushed at a time manually from the curved or flat-type magazine 20 to the slider 1 and positioned onto the slider 1, the slider 1 pushes the one-piece fixing tie 14 to the tying operation position, and the slider 1 moves back to the pre-positioned position after the tying is completed.

Seventh Embodiment

Figure 28:
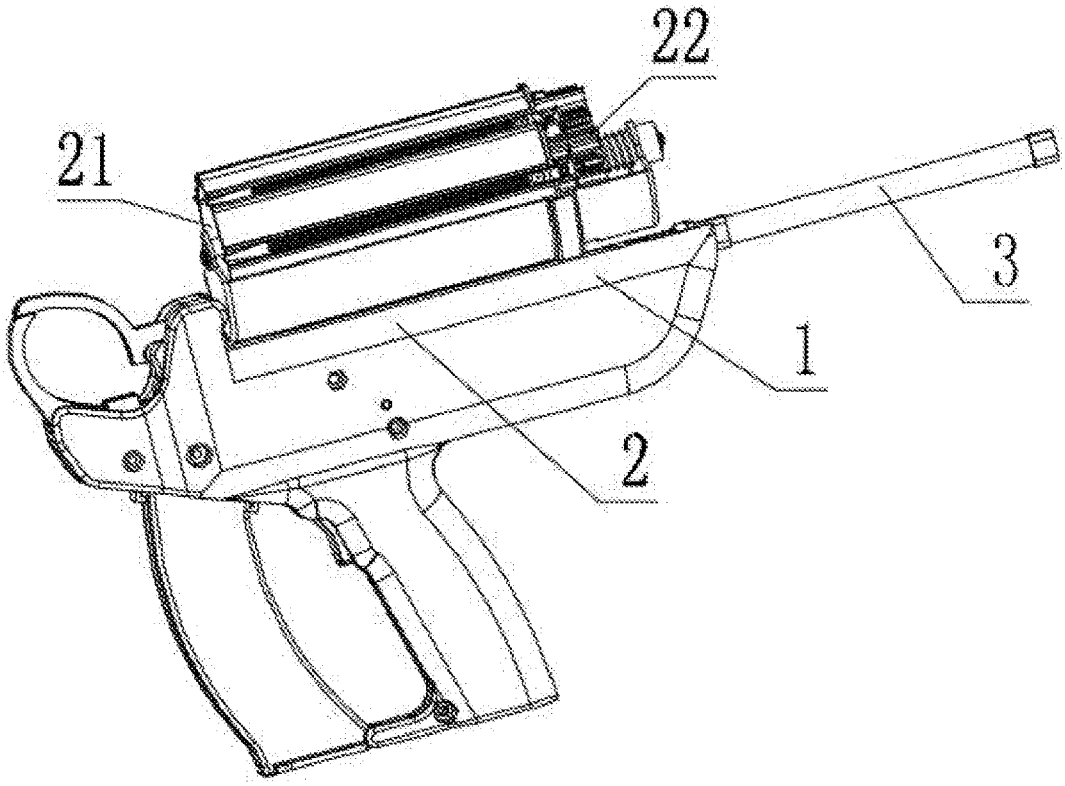
FIG. 28 is an axonometric view of a slider-based positioning mechanism according to an embodiment of the present disclosure, which is utilized in an automatic loading mode using a wheel-shaped magazine.

FIG. 28 shows a case where the embodiment of the present disclosure is utilized in an automatic tie tool with a wheel-shaped magazine 21, wherein "pits" are arranged at equal pitches in the circumference of the wheel-shaped magazine 21, and the one-piece fixing ties 14 are respectively stuck in the "pits" of the wheel-shaped magazine 21 in advance. The wheel-shaped magazine 21 is rotated by one pitch at a time and the respective "pit" of the wheel-shaped magazine 21 is aligned with the profiled recess 102 of the slider 1. When the slider 1 is in the pre-positioned position, one of the one-piece fixing ties 14 is pushed at a time by the pushing rod 22 from the wheel-shaped magazine 21 to the slider 1 and positioned onto the slider 1, the slider 1 pushes the one-piece fixing tie 14 to the tying operation position, and the slider 1 moves back to the pre-positioned position after the tying is completed.

Eighth Embodiment

Figure 29:
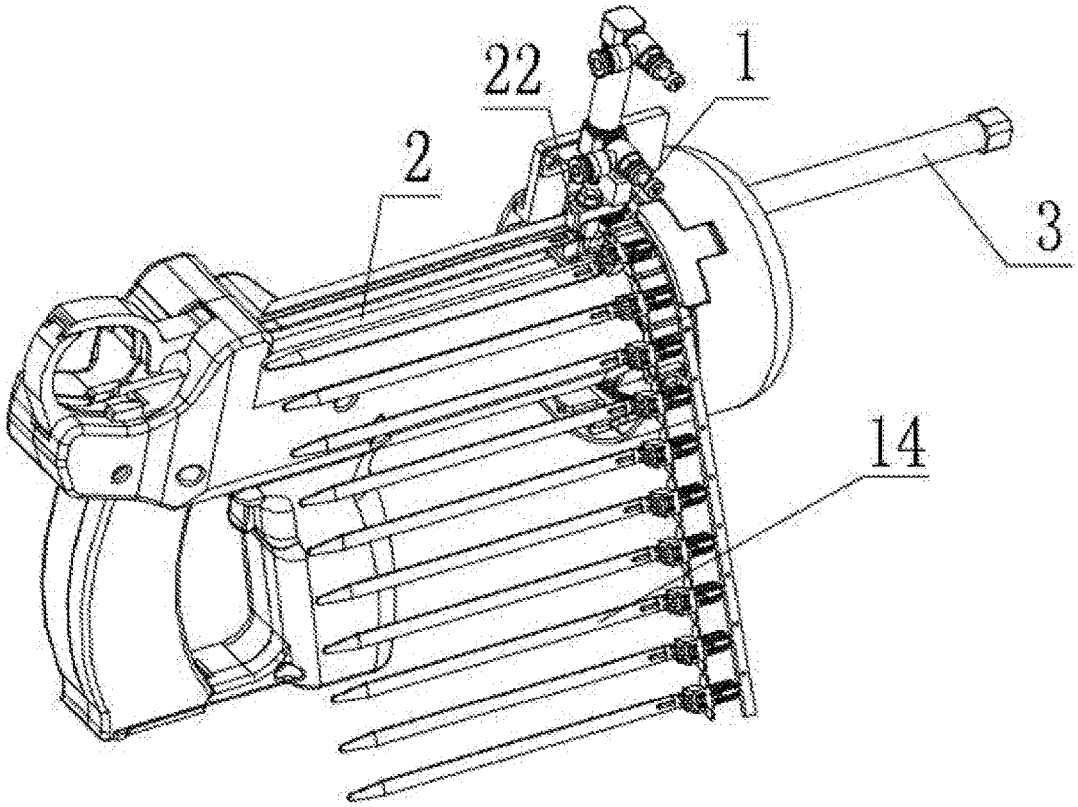
FIG. 29 is an axonometric view of a slider-based positioning mechanism according to an embodiment of the present disclosure, which is utilized in a mode of automatic loading of interconnected ties.
Figure 30:
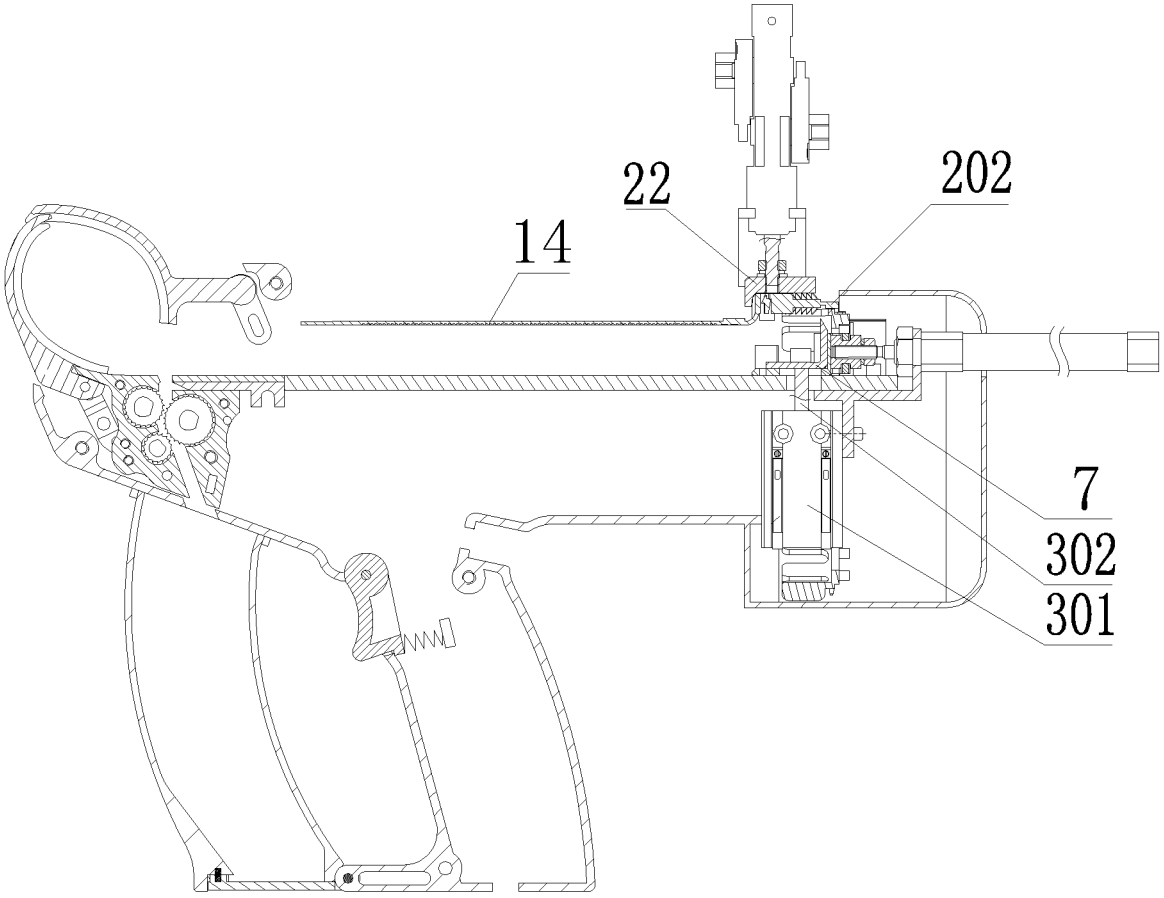
FIG. 30 is a schematic sectional view of an automatic tie tool according to an embodiment of the present disclosure.
Figure 31:
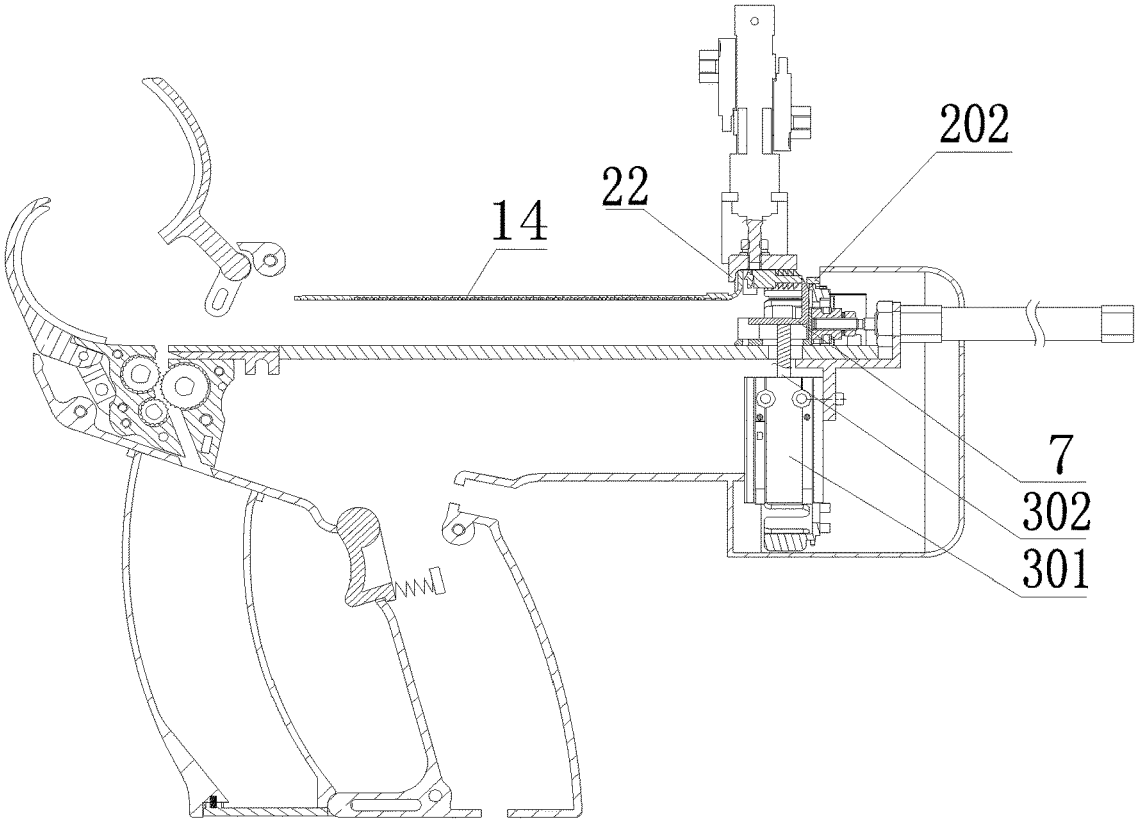
FIG. 31 is a schematic sectional view of an automatic tie tool according to an embodiment of the present disclosure, wherein a cut-off blade separates interconnected ties from a connecting plate.
Figure 32:
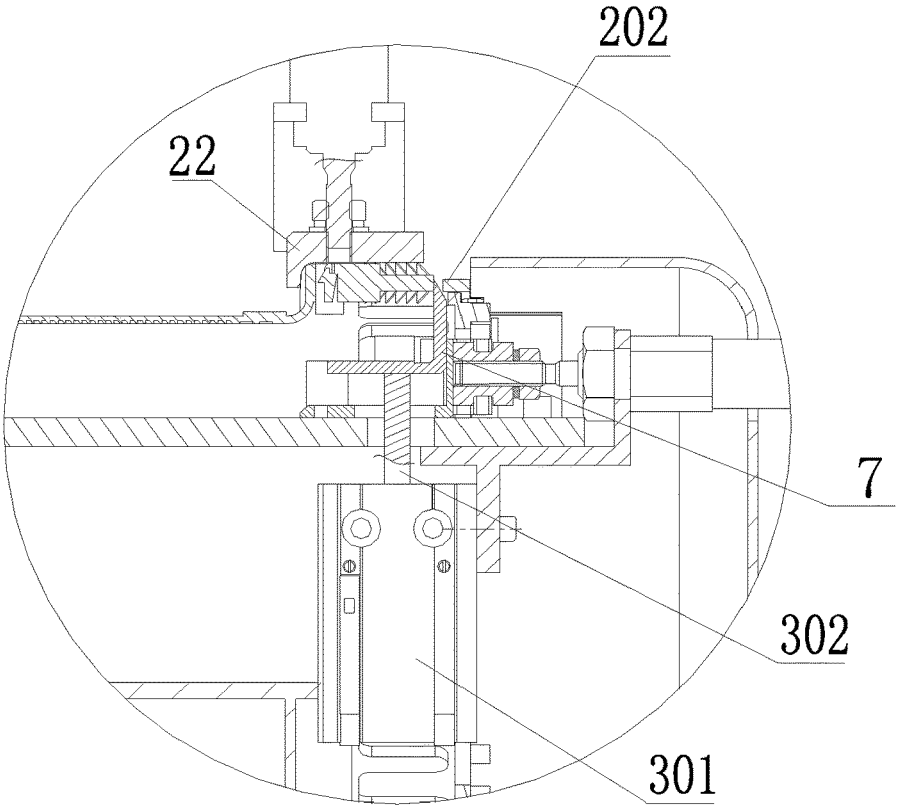
FIG. 32 is a partially enlarged view of FIG. 31.
Figure 33:
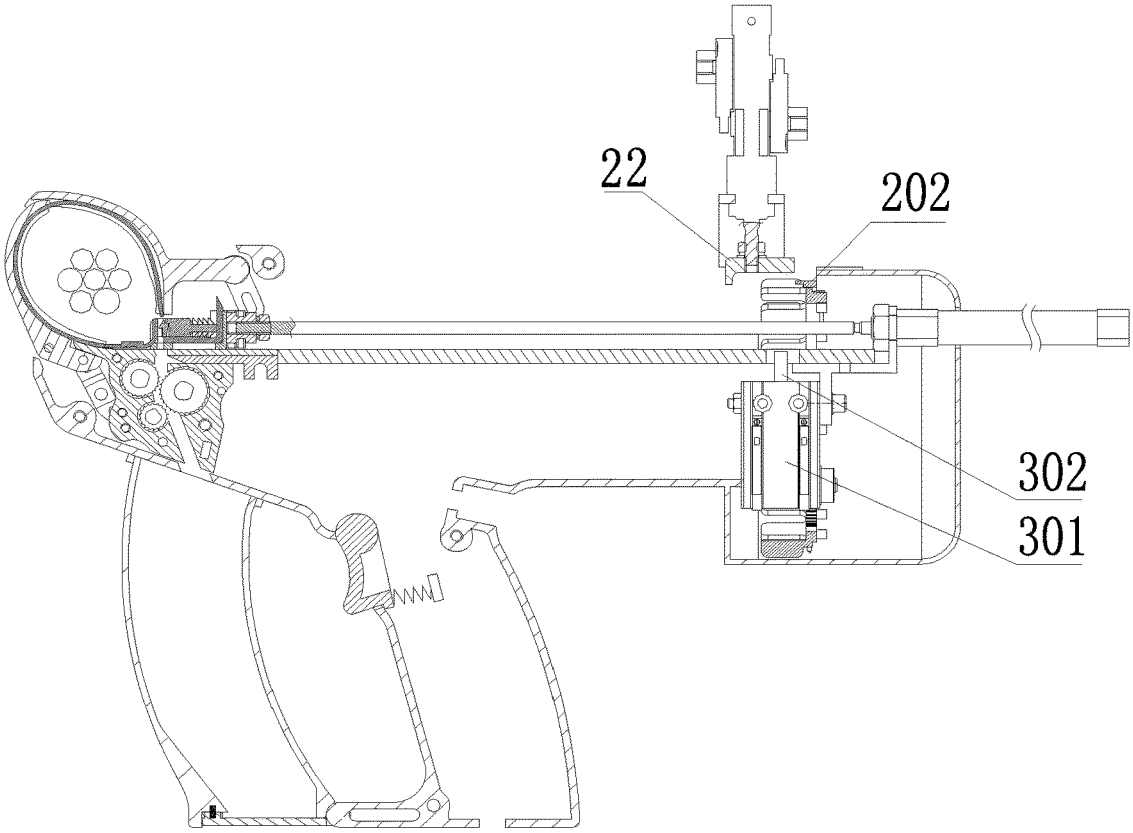
FIG. 33 is a schematic sectional view of the automatic tie tool according to an embodiment of the present disclosure, wherein a slider pushes a tie into a guide channel in a first guide claw and a second guide claw.
Figure 34:
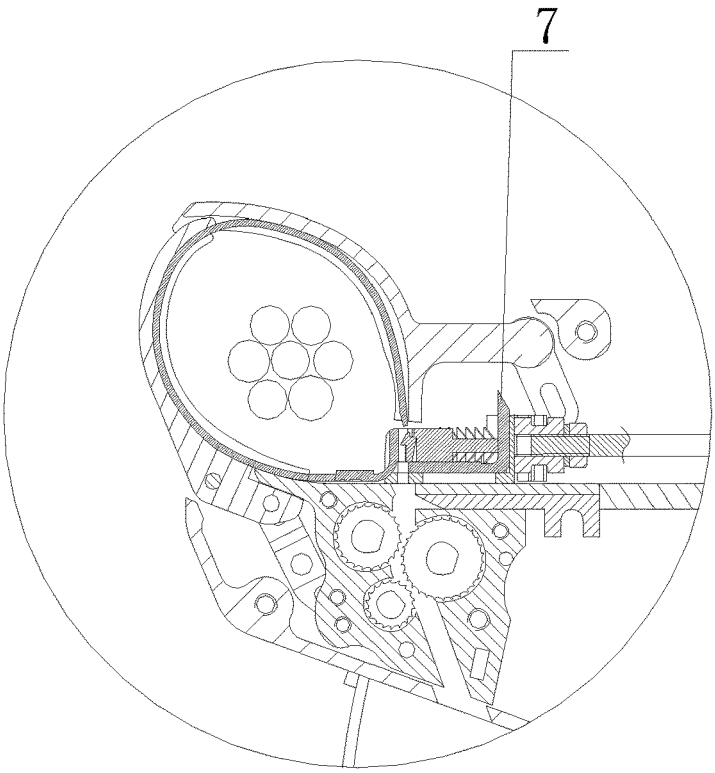
FIG. 34 is a partially enlarged view of FIG. 33.
Figure 35:
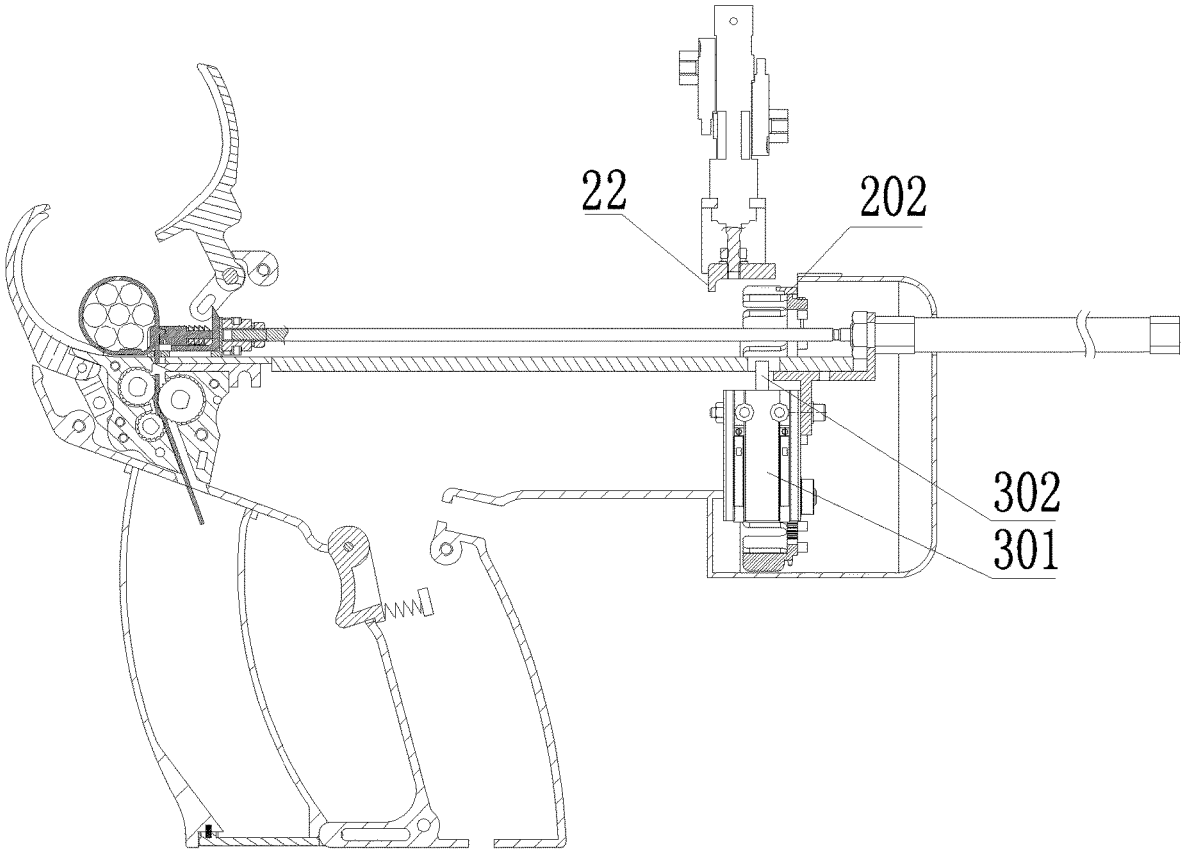
FIG. 35 is a schematic sectional view of the automatic tie tool according to an embodiment of the present disclosure, wherein a cut-off blade cuts off a tightened tie, the second guide claw is opened, and the tie is about to be withdrawn from the slider.

FIG. 29 shows a case where the embodiment of the present disclosure is utilized in an automatic tie tool using interconnected ties. The interconnected one-piece fixing ties 14 are fed by one step at a time. A one-piece fixing tie 14 which is already cut off is pushed at a time by the pushing rod 22 into the profiled recess 102 of the slider 1 and positioned therein, the slider 1 pushes the one-piece fixing tie 14 to the tying operation position, and the slider 1 moves back to the pre-positioned position when the tying is completed.

Ninth Embodiment

The methods described in the first to eighth embodiments are suitable for automatic tying of one-piece fixing ties having irregularly-shaped heads, and the methods described in the first to eighth embodiments are also suitable for automatic tying with conventional nylon ties having regularly-shaped heads.

The above description is merely illustrative of preferred embodiments of the present disclosure and is not intended to limit the present disclosure. The above embodiments may be appropriately changed or modified, by those skilled in the art to which the present disclosure relates, based on the disclosure and teaching provided in the above description. It will be understood by those skilled in the art that various changes and variations can be made to the present disclosure. Any modifications, equivalent alternatives, improvements and so on made within the spirit and principle of the present disclosure are to be included in the scope of protection of the present disclosure.

INDUSTRIAL APPLICABILITY

The automatic tie tool having a slider-based positioning mechanism of the present disclosure includes a guide rail and a slider. The slider is provided with a portion for positioning a tie, which can solve the problem of positioning of the one-piece fixing tie in the automatic tie tool. Such slider-based positioning mechanism can be used in an automatic tie tool into which ties are loaded manually, or in an automatic tool into which ties are loaded by a robotic arm, or in an automatic tie tool into which ties are loaded from a curved or flat-type magazine, or in an automatic tie tool into which ties are loaded from a wheel-shaped magazine, or in an automatic tie tool using interconnected ties.

What is claimed is:

1. An automatic tie tool having a slider-based positioning mechanism, comprising a slider and a guide rail, wherein the slider is fitted to the guide rail, five spatial degrees of freedom of the slider are restricted by the guide rail, the slider slides in a lengthwise direction of the guide rail, a head of a tie is pre-positioned onto the slider, and the slider is configured to slide in the lengthwise direction of the guide rail to push the tie from a pre-positioned position to a tying operation position, wherein the slider has a hole allowing the tie to pass therethrough.

2. The automatic tie tool having the slider-based positioning mechanism according to claim 1, wherein the hole has a shape and size matching those of the tie so that the tie can pass through the hole.

3. The automatic tie tool having the slider-based positioning mechanism according to claim 1, wherein a protrusion structure is designed to be provided on the slider, the protrusion structure comprises a convex rib group and a stop wall, and the head of the tie is stuck by the convex rib group together with the stop wall.

4. The automatic tie tool having the slider-based positioning mechanism according to claim 3, wherein a cut-off blade configured to separate the tie from a tie connecting plate is mounted on the slider, and the cut-off blade is configured to move along the guide rail along with the slider and is slidable up and down.

5. The automatic tie tool having the slider-based positioning mechanism according to claim 4, wherein positions of the convex rib group and the stop wall, and sizes of the first mounting space and the second mounting space are set according to a shape and a size of the head of a corresponding one-piece fixing tie.

6. The automatic tie tool having the slider-based positioning mechanism according to claim 3, wherein the convex rib group comprises a first convex rib group and a second convex rib group, and each of the first convex rib group and the second convex rib group comprises two convex ribs; the first convex rib group is close to edges of the slider, and the second convex rib group is close to a middle portion of the slider; the two convex ribs of the first convex rib group are disposed spaced apart and a first mounting space is formed between the two convex ribs; the two convex ribs of the second convex rib group are disposed spaced apart and a second mounting space is formed between these two convex ribs.

7. The automatic tie tool having the slider-based positioning mechanism according to claim 6, wherein positions of the convex rib group and the stop wall, and sizes of the first mounting space and the second mounting space are set according to a shape and a size of the head of a corresponding one-piece fixing tie.

8. The automatic tie tool having the slider-based positioning mechanism according to claim 3, wherein the stop wall is close to the second convex rib group to block a movement of a one-piece fixing tie in the lengthwise direction of the guide rail.

9. The automatic tie tool having the slider-based positioning mechanism according to claim 3, wherein positions of the convex rib group and the stop wall, and sizes of the first mounting space and the second mounting space are set according to a shape and a size of the head of a corresponding one-piece fixing tie.

10. The automatic tie tool having the slider-based positioning mechanism according to claim 3, wherein the convex rib group and the stop wall are replaced with a profiled recess configured to stuck the head of the tie, the profiled recess is made in the slider according to a shape and size of the head of the tie.

11. The automatic tie tool having the slider-based positioning mechanism according to claim 3, wherein the convex ribs on the slider configured to fix the head of the tie are either integrated with the slider, or split into multiple parts and fixed to the slider by using bolts or pins.

12. The automatic tie tool having the slider-based positioning mechanism according to claim 3, wherein the convex ribs are formed integrally with or detachably connected with the slider.

13. The automatic tie tool having the slider-based positioning mechanism according to claim 1, wherein the slider is driven directly by a cylinder, or driven by a belt, or by a screw-nut transmission pair, or by being pushed out by a spring and pulled back by a flexible cord, or by serially-connected four-bar mechanisms with an increased stroke, or by a toggle mechanism with an increased stroke, or by a stroke-increasing rocker-slider mechanism, or by a stroke-increasing crank-slider mechanism.

14. The automatic tie tool having the slider-based positioning mechanism according to claim 13, wherein the belt, or the screw-nut transmission pair, or the flexible cord, or the serially-connected multiple sets of four-bar mechanisms, or the toggle mechanism, or the rocker-slider mechanism, or the crank-slider mechanism is driven by pneumatic power or electric power.

15. The automatic tie tool having the slider-based positioning mechanism according to claim 1, wherein the slider is configured to have a groove-shaped or hole-shaped slidable fitting portion which is slidably fitted to the guide rail, and the guide rail is mounted to the slidable fitting portion.

16. The automatic tie tool having the slider-based positioning mechanism according to claim 1, wherein the slider and the guide rail are fitted with each other in a cross section which is in a rectangle shape, or a double circular or arcuate shape, or a triangle, or a splined shape, or a combination of the above-mentioned basic cross-sectional shapes.

17. The automatic tie tool having the slider-based positioning mechanism according to claim 1, wherein the automatic tie tool having a slider-based positioning mechanism is used in an automatic tie tool into which ties are loaded manually, or in an automatic tool into which ties are loaded by a robotic arm, or in an automatic tie tool into which ties are loaded from a curved or flat-type magazine, or in an automatic tie tool into which ties are loaded from a wheel-shaped magazine, or in an automatic tie tool using interconnected ties.

18. The automatic tie tool having the slider-based positioning mechanism according to claim 1, wherein the automatic tie tool having a slider-based positioning mechanism is either used in an automatic tying tool for one-piece fixing ties having irregularly-shaped heads, or used in an automatic tying tool for conventional nylon ties having regularly-shaped heads.

19. A device, comprising the automatic tie tool having the slider-based positioning mechanism according to claim 1.

* * * * *